US007987093B2

(12) United States Patent
Noda

(10) Patent No.: US 7,987,093 B2
(45) Date of Patent: Jul. 26, 2011

(54) SPEECH SYNTHESIZING DEVICE, SPEECH SYNTHESIZING SYSTEM, LANGUAGE PROCESSING DEVICE, SPEECH SYNTHESIZING METHOD AND RECORDING MEDIUM

(75) Inventor: Takuya Noda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 12/550,883

(22) Filed: Aug. 31, 2009

(65) Prior Publication Data

US 2009/0319275 A1 Dec. 24, 2009

Related U.S. Application Data

(63) Continuation of application No. PCT/JP2007/055766, filed on Mar. 20, 2007.

(51) Int. Cl.
*G10L 13/00* (2006.01)

(52) U.S. Cl. ..... 704/260; 704/258; 715/758; 715/977

(58) Field of Classification Search ..... 704/258, 704/260; 715/758, 977
See application file for complete search history.

(56) References Cited

U.S. PATENT DOCUMENTS

| | | | | |
|---|---|---|---|---|
| 7,103,548 | B2 * | 9/2006 | Squibbs et al. | 704/260 |
| 2002/0184028 | A1 | 12/2002 | Sasaki | |
| 2002/0194006 | A1 * | 12/2002 | Challapali | 704/276 |
| 2003/0158734 | A1 * | 8/2003 | Cruickshank | 704/260 |
| 2004/0107101 | A1 * | 6/2004 | Eide | 704/260 |
| 2008/0288257 | A1 * | 11/2008 | Eide | 704/260 |

FOREIGN PATENT DOCUMENTS

| | | |
|---|---|---|
| JP | A 11-305987 | 11/1999 |
| JP | A 2001-337688 | 12/2001 |
| JP | A 2002-169750 | 6/2002 |
| JP | 2002-268665 | 9/2002 |
| JP | A 2003-150507 | 5/2003 |
| JP | A 2004-23225 | 1/2004 |
| JP | A 2005-284192 | 10/2005 |
| JP | A 2006-184642 | 7/2006 |

* cited by examiner

*Primary Examiner* — Daniel D Abebe
(74) *Attorney, Agent, or Firm* — Fujitsu Patent Center

(57) ABSTRACT

A speech synthesizing device, the device includes: a text accepting unit for accepting text data; an extracting unit for extracting a special character including a pictographic character, a face mark or a symbol from text data accepted by the text accepting unit; a dictionary database in which a plurality of special characters and a plurality of phonetic expressions for each special character are registered; a selecting unit for selecting a phonetic expression of an extracted special character from the dictionary database when the extracting unit extracts the special character; a converting unit for converting the text data accepted by the accepting unit to a phonogram in accordance with a phonetic expression selected by the selecting unit in association with the extracted special character; and a speech synthesizing unit for synthesizing a voice from a phonogram obtained by the converting unit.

20 Claims, 18 Drawing Sheets

FIG. 3

| | EXPRESSION 1 | EXPRESSION 2 | IDENTIFICATION CODE | IMAGE |
|---|---|---|---|---|
| CANDIDATE 1 | BA−SUDE− (birthday) | PACHIPACHI (clap−clap) | × × | 1 |
| CANDIDATE 2 | ROUSOKU (candle) | POKUPOKUCHI−N (flickering) | | |

FIG. 5 A

HAPPI— ¡¡¡
(Happy ¡¡¡)

↓

「HAPPI—BA'—SUDE— 」
「ha`epi be' rthde` i」

√ HAPPI—BA'—SUDE—
(Happy「birthday」)

FIG. 5 B

OTANZYOUBI OMEDETOU ¡¡¡
(Happy Birthday ¡¡¡)

↓

「OTANZYO'—BI, OMEDETO—, PA'CHIPA'CHI 」
「ha`epi be' rthde` i, klaep klaep」

√ OTANZYOBI OMEDETOU「PACHIPACHI」
(Happy birthday「clap—clap」)

FIG. 7

| | EXPRESSION 1 | EXPRESSION 2 | EXPRESSION 3 | IDENTIFICATION CODE | IMAGE |
|---|---|---|---|---|---|
| CANDIDATE 1 | BA−SUDE− (birthday) | PACHIPACHI (clap−clap) | "Happy Birthday" | × × | |
| CANDIDATE 2 | ROUSOKU (candle) | POKUPOKUCHI−N (flickering) | "OKYO" ("Ave Maria") | | |

FIG. 8

| | EXPRESSION 1 | EXPRESSION 2 | EXPRESSION 1 RELATED TERM | EXPRESSION 2 RELATED TERM | IDENTIFICATION CODE | IMAGE |
|---|---|---|---|---|---|---|
| CANDIDATE 1 | BA-SUDE- (birthday) | PACHIPACHI (clap clap) | HAPPI-PACHIPACHI (happy) (clap) | HAKUSHU TANZYOBI BA-SUDE- (conglatulation) (applause) (birthday) | XX | |
| CANDIDATE 2 | ROUSOKU (candles) | POKUPOKUCHI-N (flickering) | BUTSUDAN TEIDEN POKUPOKUCHI-N (altar) (blackout) (flick) | MOKUGYO RIN ROUSOKU (pray) (candles) | | |

FIG. 10

| | EXPRESSION 1 | EXPRESSION 2 | EXPRESSION 3 | EXPRESSION 1 SYNONYMOUS TERM | EXPRESSION 1 SYNONYMOUS TERM |
|---|---|---|---|---|---|
| CANDIDATE 1 | BA-SUDE- (birthday) | PACHIPACHI (clap clap) | "Happy Birthday" | BA-SUDE-TANZYOBI (birthday) | PACHIPACHI (clap) |
| CANDIDATE 2 | ROUSOKU (candles) | POKUPOKUCHI-N (flickering) | "OKYO" ("Ave Maria") | ROUSOKU (candles) | POKUPOKU CHI-N (flick) (glitter) (twinkle) |

| EXPRESSION 1 RELATED TERM | EXPRESSION 2 RELATED TERM | IDENTIFICATION CODE | IMAGE |
|---|---|---|---|
| HAPPI- (happy) | HAKUSHU OMEDETOU (applause) (congratulation) | XX | 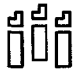 |
| BUTSUDAN TEIDEN (altar) (blackout) | MOKUGYO RIN (pray) | | |

SPEECH SYNTHESIZING DEVICE, SPEECH SYNTHESIZING SYSTEM, LANGUAGE PROCESSING DEVICE, SPEECH SYNTHESIZING METHOD AND RECORDING MEDIUM

CROSS-REFERENCE TO RELATED APPLICATIONS

This application is a continuation, filed under U.S.C. §111 (a), of PCT International Application No. PCT/JP2007/055766 which has an international filing date of Mar. 20, 2007 and designated the United States of America.

FIELD

The invention discussed herein is related to a speech synthesizing method which realizes read-aloud of text by converting text data to a synthesized voice.

BACKGROUND

As the speech synthesis technology advances, a speech synthesizing device which can read aloud an electronic mail, for example, by synthesizing and outputting a voice corresponding to text has been developed.

The technology for reading aloud text is attracting attention as a technology fitting a universal design which enables elderly persons or visually-impaired persons, who have difficulty in recognizing characters visually to use of the electronic mail service, as others.

For example, a computer program which allows a PC (Personal Computer) capable of transmitting and receiving an electronic mail to realize read-aloud of text of a mail or read-aloud a Web document has been provided. Moreover, a mobile telephone, which has a small character display screen causing trouble in reading characters, is sometimes equipped with a mail read-aloud function.

Such a conventional text read-aloud technology basically includes a construction to convert text to a "reading" corresponding to the meaning thereof and read aloud the text.

However, in the case of Japanese, a character included in text is not limited to a hiragana character, a katakana character, a kanji character, an alphabetic character, a numeric character and a symbol, and a character string (so-called face mark) made up of a combination thereof is sometimes used to represent feelings. Even in the case of a language other than Japanese, a character string (so-called Emoticon, Smiley and the like) made up of a combination of characters, numeric characters and symbols is sometimes used to represent feelings. A special character referred to as a "pictographic character" may be included in text as well as a hiragana character, a katakana character, a kanji character, an alphabetic character, a numeric character and a symbol as a specific function of a mobile telephone especially in Japan, and the function is used frequently.

A user can convey his feelings to the other party through text by inserting a special character described above, such as a face mark, a pictographic character and a symbol, in his text.

In the meantime, a technology to be used for properly reading aloud text including a special character has been developed in the field of speech synthesis.

According to Japanese Laid-open Patent Publication No. 2001-337688, discloses a technology for reading aloud a character string in a prosody according to delight, anger, sorrow and pleasure, each of which is associated with the meaning of a detected character string or a detected special character, when a given character string included in text is detected.

Moreover, a technology which can prevent redundant read-aloud by deleting the character string and performing conversion to text data to be used for speech synthesis is discussed, when a character string coincident with a "reading" corresponding to the meaning set for a face mark or a symbol exists immediately before or immediately after a face mark or a symbol (see, Japanese Laid-open Patent Publication No. 2006-184642).

SUMMARY

According to an aspect of the embodiments, a speech synthesizing device, the device includes: a text accepting unit for accepting text data; an extracting unit for extracting a special character including a pictographic character, a face mark or a symbol from text data accepted by the text accepting unit; a dictionary database in which a plurality of special characters and a plurality of phonetic expressions for each special character are registered; a selecting unit for selecting a phonetic expression of an extracted special character from the dictionary database when the extracting unit extracts the special character; a converting unit for converting the text data accepted by the accepting unit to a phonogram in accordance with a phonetic expression selected by the selecting unit in association with the extracted special character; and a speech synthesizing unit for synthesizing a voice from a phonogram obtained by the converting unit.

The object and advantages of the invention will be realized and attained by the elements and combinations particularly pointed out in the claims. It is to be understood that both the foregoing general description and the following detailed description are exemplary and explanatory and are not restrictive of the embodiment, as claimed.

BRIEF DESCRIPTION OF DRAWINGS

FIG. 3 is an explanatory view for illustrating an example of the content of a special character dictionary stored in a memory unit of a speech synthesizing device according to Embodiment 1.

FIG. 5A and FIG. 5B are explanatory views for conceptually illustrating selection of a phonetic expression corresponding to a pictographic character performed by a control unit of a speech synthesizing device according to Embodiment 1.

FIG. 7 is an explanatory view for illustrating an example of the content of a special character dictionary stored in a memory unit of a speech synthesizing device according to Embodiment 2.

FIG. 8 is an explanatory view for illustrating an example of the content of a special character dictionary to be stored in a memory unit of a speech synthesizing device according to Embodiment 3.

FIG. 10 is an explanatory view for illustrating an example of the content of a special character dictionary to be stored in a memory unit of a speech synthesizing device according to Embodiment 4.

DESCRIPTION OF EMBODIMENTS

Embodiment 1

Present embodiment is not limited to Japanese, though the following description of the embodiments mainly explains an example of Japanese as an example of text data to be accepted. A specific example of text data, which is in a language other than Japanese, especially English, will be put in brackets [ ].

Figure 1:
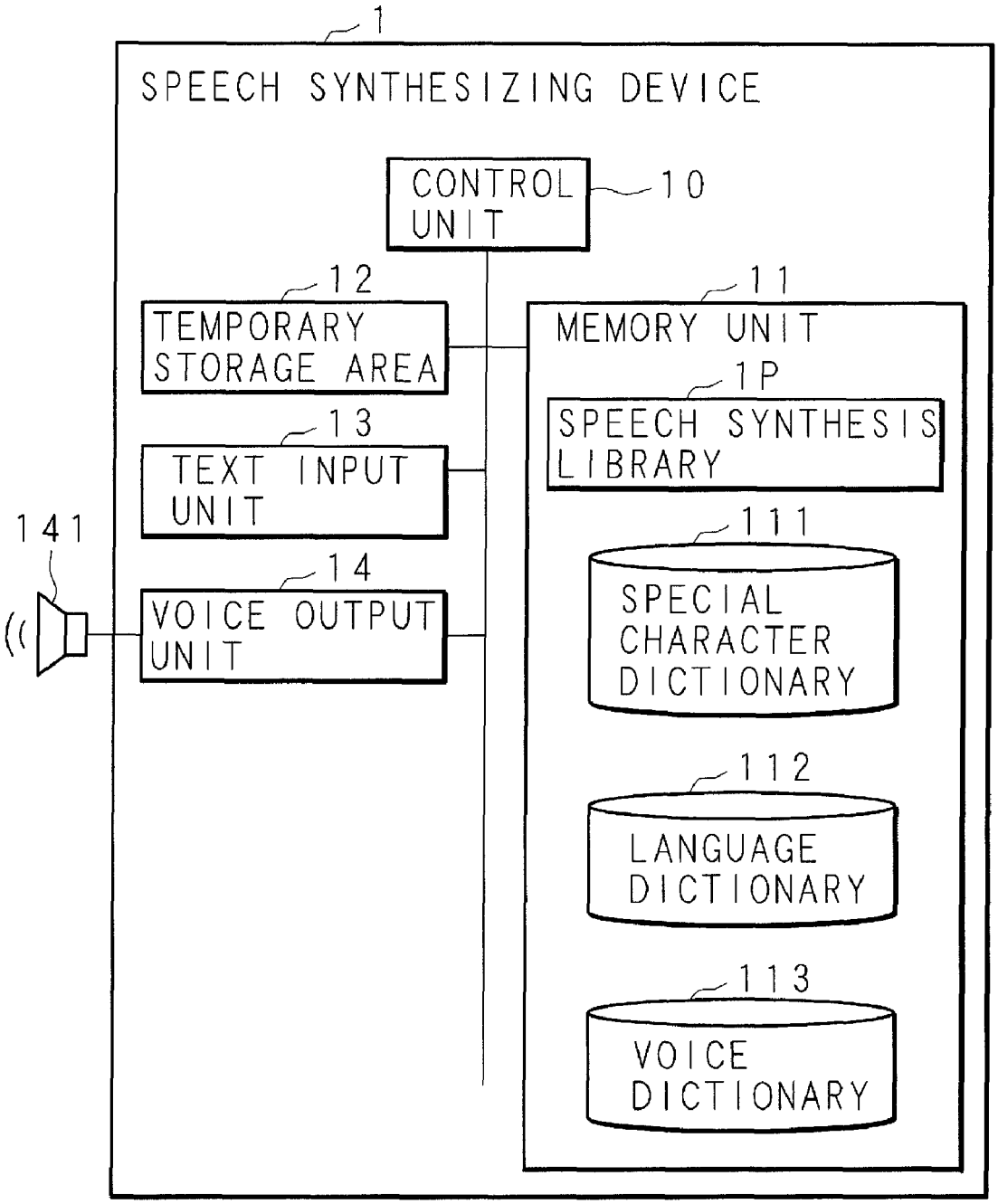
FIG. 1 is a block diagram for illustrating an example of the structure of a speech synthesizing device according to Embodiment 1.

FIG. 1 is a block diagram for illustrating an example of the structure of a speech synthesizing device according to Embodiment 1. A speech synthesizing device includes: a control unit 10 for controlling the operation of each component which will be explained below; a memory unit 11 which is a hard disk, for example; a temporary storage area 12 provided with a memory such as a RAM (Random Access Memory); a text input unit 13 provided with a keyboard, for example; and a voice output unit 14 provided with a loud speaker 141.

The memory unit 11 stores a speech synthesizing library 1P which is a program group to be used for executing the process of speech synthesis. The control unit 10 reads out an application program, which incorporates the speech synthesizing library 1P, from the memory unit 11 and executes the application program so as to execute each operation of speech synthesis.

The memory unit 11 further stores: a special character dictionary 111 constituted of a database in which data of a special character such as a pictographic character, a face mark and a symbol and data of a phonetic expression including a phonetic expression of a reading of a special character are registered; a language dictionary 112 constituted of a database in which correspondence of a segment, a word and the like constituting text data with a phonogram is registered; and a voice dictionary (waveform dictionary) 113 constituted of a database in which a waveform group of each voice is registered.

In concrete terms, an identification code given to a special character such as a pictographic character or a symbol is registered in the special character dictionary 111 as data of a special character. Moreover, since a face mark of a special character is a combination of symbols and/or characters, combination of identification codes of symbols and/or characters constituting a face mark is registered in the special character dictionary 111 as data of a special character. Furthermore, information indicative of an expression method for outputting a special character as a voice, e.g., a character string representing the content of a phonetic expression is registered in the special character dictionary 111.

Moreover, the control unit 10 may rewrite the content of the special character dictionary 111. When accepting input of a new phonetic expression corresponding to a special character, the control unit 10 registers the phonetic expression corresponding to the special character in the special character dictionary 111.

The temporary storage area 12 is used not only for reading out the speech synthesizing library 1P by the control unit 10 but also for reading out a variety of information from the special character dictionary 111, from the language dictionary 112 or from the voice dictionary 113, or for temporarily storing a variety of information which is generated in execution of each process.

The text input unit 13 is part, such as a keyboard, a letter key and a mouse, for accepting input of text. The control unit 10 accepts text data to be inputted through the text input unit 13. For creating text data including a special character, a user selects a special character by operating the keyboard, the letter key the mouse or the like provided in the text input unit 13, so as to insert the special character in text data excluding a special character.

The device may be constructed in such a manner that the user may input a character string representing a phonetic expression of a special character or select particular effect such as a sound effect or music through the text input unit 13.

The voice output unit 14 is provided with the loud speaker 141. The control unit 10 gives a speech synthesized by using the speech synthesizing library 1P to the voice output unit 14 and causes the voice output unit 14 to output the voice through the loud speaker 141.

Figure 2:
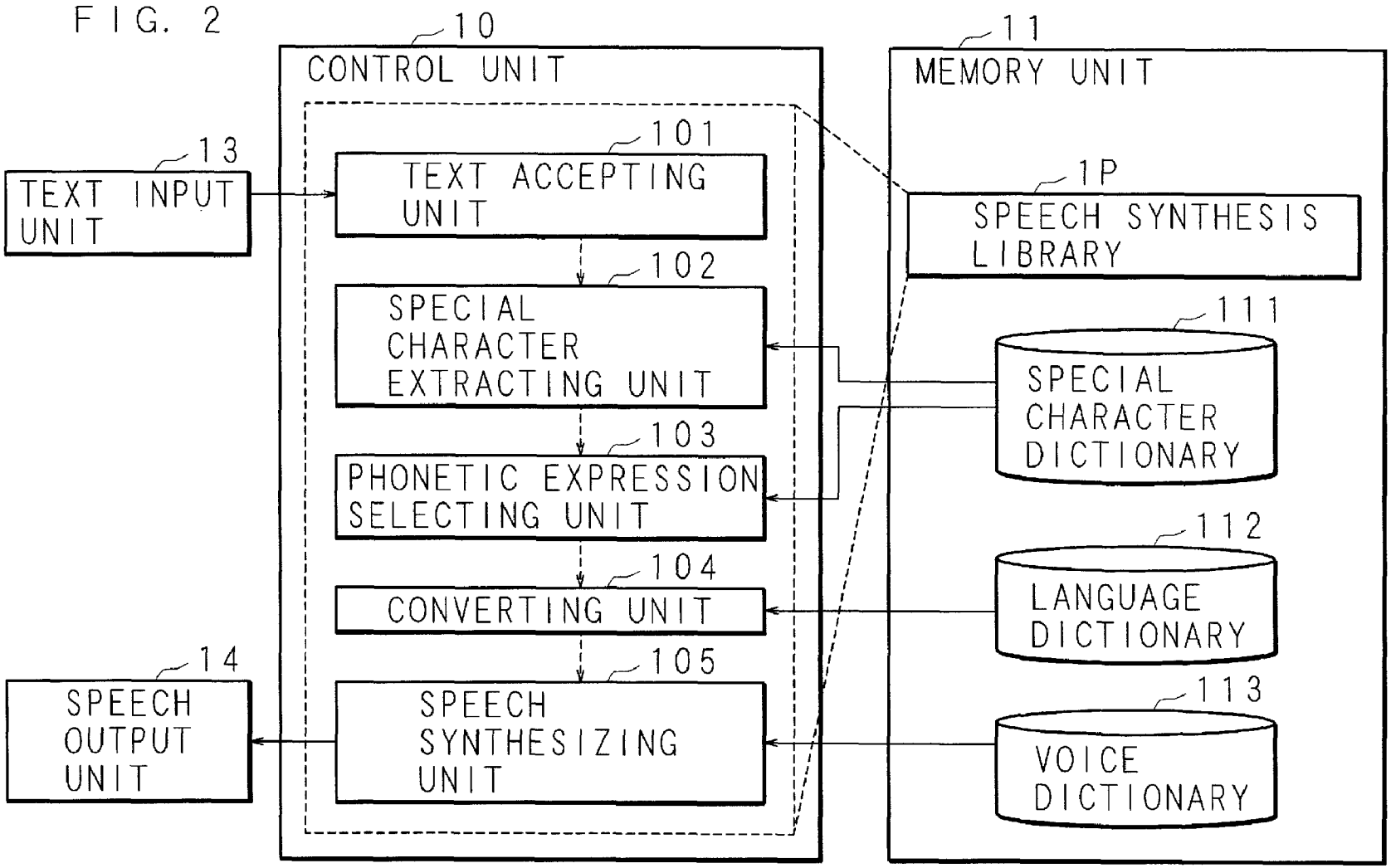
FIG. 2 is an example of a functional block diagram for illustrating an example of each function to be realized by a control unit of a speech synthesizing device according to Embodiment 1.

FIG. 2 is an example of a functional block diagram for illustrating an example of each function to be realized by a control unit 10 of a speech synthesizing device 1 according to Embodiment 1. By executing an application program which incorporates the speech synthesizing library 1P, the control unit 10 of the speech synthesizing device 1 functions as: a text accepting unit 101 for accepting text data inputted through the text input unit 13; a special character extracting unit 102 for extracting a special character from the text data accepted by the text accepting unit 101; a phonetic expression selecting unit 103 for selecting a phonetic expression for the extracted special character; a converting unit 104 for converting the accepted text data to a phonogram in accordance with the phonetic expression selected for the special character; and a speech synthesizing unit 105 for creating a synthesized voice from the phonogram obtained through conversion by the converting unit 104 and outputting the synthesized voice to the voice output unit 14.

The control unit 10 functioning as the text accepting unit 101 accepts text data inputted through the text input unit 13.

The control unit 10 functioning as the special character extracting unit 102 matches the accepted text data against a special character preregistered in the special character dictionary 111. The control unit 10 recognizes a special character by matching the text data accepted by the text accepting unit 101 against an identification code of a special character preregistered in the special character dictionary 111 and extracts the special character.

In concrete terms, when a special character is a pictographic character or a symbol, an identification code given to the pictographic character or the symbol is registered in the special character dictionary 111. Accordingly, the control unit 10 can extract a pictographic character or a symbol when a character string coincident with a registered identification code given to a special character exists in text data.

When a special character is a face mark, a combination of identification codes respectively of symbols and/or characters, which constitute a face mark, is registered in the special character dictionary 111. Accordingly, the control unit 10 can extract a face mark when a character string coincident with combination of identification codes registered in the special character dictionary 111 exists in text data.

When extracting a special character by functioning as the special character extracting unit 102, the control unit 10 notifies an identification code or a string of identification codes corresponding to the special character to the phonetic expression selecting unit 103.

The control unit 10 functioning as the phonetic expression selecting unit 103 accepts an identification code or a string of identification codes corresponding to a special character and selects one of phonetic expressions associated with the accepted identification code or string of identification codes from the special character dictionary 111. The control unit 10 replaces the special character in text data with a character string equivalent to the phonetic expression selected from the special character dictionary 111.

The control unit 10 functioning as the converting unit 104 makes a language analysis of text data including a character string equivalent to a phonetic expression selected for a special character while referring to the language dictionary 112 and converts the text data to a phonogram. For making a language analysis, the control unit 10 matches the text data against a word registered in the language dictionary 112. When a word coincident with a word registered in the language dictionary 112 is detected as a result of matching, the control unit 10 performs conversion to a phonogram corresponding to the detected word. A phonogram which will be described below uses katakana character transcription in the case of Japanese and uses a phonetic symbol in the case of English. As a result of a language analysis by functioning as the converting unit 104, the control unit 10 represents the accent position and the pause position respectively using "'(apostrophe)" as an accent symbol and ", (comma)" as a pause symbol.

In the case of Japanese, for example, when accepting text data of "birthday (Otanjoubi) congratulations (Omedetou)", the control unit 10 detects "birthday (Otanjoubi)" coincident with "birthday (Otanjoubi)" registered in the language dictionary 112, and performs conversion to a phonogram of"O-TANJO'-BI", which is registered in the language dictionary 112 in association with the detected "birthday (Otanjoubi)". Next, the control unit 10 detects "congratulations (Omedetou)" coincident with "congratulations (Omedetou)" registered in the language dictionary 112, and performs conversion to "OMEDETO-", which is registered in the language dictionary 112 in association with the detected "congratulations (Omedetou)". The control unit 10 inserts a pause between the detected "birthday (Otanjoubi)" and "congratulations (Omedetou)", and performs conversion to a phonogram of"OTANJO'-BI, OMEDETO-".

In the case of English, when accepting text data "Happy birthday", the control unit 10 detects "Happy" coincident with "happy" registered in the language dictionary 112 and performs conversion to a phonogram "haepi", which is registered in the language dictionary 112 in association with the detected "happy". Next, the control unit 10 detects "birthday" coincident with "birthday" registered in the language dictionary 112 and performs conversion to "be'rthdei", which is registered in the language dictionary 112 in association with the detected "birthday". The control unit 10 inserts a pause between the detected "happy" and "birthday", and performs conversion to a phonogram of "haepi be'rthdei".

It is to be noted that the function as the converting unit 104 and the language dictionary 112 can be realized by using a heretofore known technology for conversion to a phonogram by which the speech synthesizing unit 105 converts text data to a voice.

The control unit 10 functioning as the speech synthesizing unit 105 matches the phonogram obtained through conversion by the converting unit 104 against a character registered in the voice dictionary 113 and combines voice waveform data associated with a character so as to synthesize a voice. The function as the speech synthesizing unit 105 and the voice dictionary 113 can also be realized by using a heretofore known technology for speech synthesis associated with a phonogram.

The following description will explain how the control unit 10 functioning as the phonetic expression selecting unit 103 in the speech synthesizing device 1 selects information indicative of a phonetic expression corresponding to an extracted special character from the special character dictionary 111.

FIG. 3 is an explanatory view for illustrating an example of the content of the special character dictionary 111 stored in the memory unit 11 of the speech synthesizing device 1 according to Embodiment 1.

As illustrated in the explanatory view of FIG. 3, a pictographic character of an image of "three candles", for which an identification code "XX" is set, is registered in the special character dictionary 111 as a special character. Four phonetic expressions are registered for the pictographic character of the image of "three candles". Four phonetic expressions are respectively; a phonetic expression to read out a meaning of a pictographic character as "birthday (BA-SUDE-) [birthday] "; an imitative word of applause "PACHIPACHI [clap-clap]"; a phonetic expression to read out a meaning of a pictographic character "candle (Rousoku) [candles]"; and an imitative word of "a singing bowl and a wooden fish" which is to be associated with candles [an imitative word representing light of a candle] "POKUPOKUCHI-N [flickering]". Moreover, four phonetic expressions are classified depending on the content of the pictographic character into: Expression 1, which is a phonetic expression of the most suitable read-aloud for the case where a pictographic character is used as a substitute for a character or characters; and Expression 2, which is a phonetic expression suitable for the case where a pictographic character is used as something other than a substitution for a character or characters. Furthermore, phonetic expressions are classified into Candidate 1/Candidate 2, which is distinguished by a meaning to be recalled from the design of a pictographic character.

For a pictographic character of the design of "three candles" illustrated in the explanatory view of FIG. 3, a phonetic expression to be read aloud "birthday (BA-SUDE-) [birthday]" is registered as a phonetic expression for the case where the pictographic character is used as a substitute for a character or characters and in a meaning which recalls a birthday cake. Moreover, a phonetic expression to read out "candle (Rousoku) [candles]" is registered as a phonetic expression for the case where the pictographic character is used as substitution of a character and in a meaning which simply recalls a candle. On the other hand, a phonetic expression "PACHIPACHI" of a reading of an imitative word or a sound effect of applause which is to be associated with "birthday (BA-SUDE-) [birthday]" is registered as a phonetic expression for the case where the pictographic character is used as something other than a substitution for a character or characters and in a meaning which recalls a birthday cake. A phonetic expression "POKUPOKUCHI-N [flickering]" which is a sound effect or a reading of an imitative word that is to be associated with the case where a candle is offered at the Buddhist altar [altar] [an imitative word representing light of a candle] is registered as a phonetic expression for the case where the pictographic character is used as something other than a substitution for a character or characters and in a meaning which simply recalls a candle.

The control unit 10 functions as the phonetic expression selecting unit 103, refers to the special character dictionary 111, in which a phonetic expression of a special character is classified and registered as illustrated in the explanatory view of FIG. 3, and selects a phonetic expression from a plurality of phonetic expressions corresponding to the extracted special character.

One of specific examples of a method for selecting a phonetic expression from the special character dictionary 111 by the control unit 10 functioning as the phonetic expression selecting unit 103 is the following method, when received text data is in Japanese.

The control unit 10 separates text data before and after a special character into linguistic units such as segments and words by a language analysis. The control unit 10 grammatically classifies the separated linguistic units, and selects a phonetic expression, which is classified into Expression 1, when a linguistic unit is classified as a particle immediately before or immediately after a special character. When a word classified as a particle is used immediately before or immediately after a special character, it is possible to judge that the special character is used as a substitute for a character or characters.

Moreover, when a word which is grammatically classified as a prenominal form of an adjective is used immediately before a special character and there is no noun after the special character, it is considered that the special character is likely to be a noun. Accordingly the control unit 10 can also determine that the special character is used as a substitute for a character or characters. On the contrary when a word which is classified as a prenominal form of an adjective is used immediately before a special character and there is a noun after the special character, it is considered that the special character does not especially have a grammatical meaning and is used as a decoration of text, a simple break or the like. Accordingly, the control unit 10 can also determine that the special character is used as something other than a substitution for a character or characters.

Moreover, a term group which is considered to have a meaning close to a meaning to be recalled may be registered in association respectively with a "meaning to be recalled from the design" for a pictographic character for which an identification code "XX" is set. The control unit 10 determines whether or not any one of the registered group of terms is detected from a linguistic unit of a sentence in text data including a special character. The control unit 10 selects Candidate 1 or Candidate 2, which is classified by a "meaning to be recalled from the design" that is associated with the term group including the detected term. Furthermore, it is also possible to select any one of the phonetic expressions by combining whether a particle is used immediately before or immediately after a special character or not as described above.

The control unit 10 may use the following method for selecting a phonetic expression from the special character dictionary 111 as the phonetic expression selecting unit 103. The control unit 10 determines whether or not a character string equivalent to the same phonetic expression as any one of phonetic expressions registered for a special character is included in the proximity of a special character in text data, e.g., in a linguistic unit of a sentence in text data including a special character, and when a character string equivalent to the same phonetic expression is included, avoids to select the a phonetic expression. Accordingly when a character string equivalent to the same phonetic expression is included in the proximity of a special character, a phonetic expression may be selected that belongs to the same "candidate", i.e., classification based on "meaning to be recalled from the design" of the included phonetic expression and belongs to a different "expression", i.e., classification based on its usage. In the example illustrated in the explanatory view of FIG. 3, when an identification code "XX" is extracted from text data, for example, the control unit 10 reads out a sentence including the identification code "XX" and makes a language analysis. When it is determined that "birthday (BA-SUDE-)" is included in the sentence as a result of separation into linguistic units such as segments and words by a language analysis, the control unit 10 selects a phonetic expression "PACHIPACHI" which belongs to Candidate 1 of the same meaning to be recalled from the design as that of "birthday (BA-SUDE-)" and to Expression 2 which indicates a different way of usage. On the contrary, when it is determined that "candle (Rousoku)" is included in proximity text data, the control unit 10 selects a phonetic expression "POKUPOKUCHI-N" belonging to Candidate 2 of the same meaning to be recalled from the design as that of "candle (Rousoku)" and to a different way of usage.

Furthermore, the method for selecting a phonetic expression from the special character dictionary 111 by the control unit 10 functioning as the phonetic expression selecting unit 103 may be selected on the basis of a proximity word or a grammatical analysis as described above, even when accepted text data is in a language other than Japanese. When a word classified as a prenominal form of an adjective is used immediately before a special character and there is no noun after the special character, it is possible to determine that the special character is used as a substitute for a character or characters. Moreover, it is also possible to judge whether a sentence is completed immediately before a special character or not by a language analysis and to determine that the special character is used as something other than a substitution for a character or characters when the sentence is completed.

It is to be noted that the method for selecting a phonetic expression registered in the special character dictionary 111 by the control unit 10 functioning as the phonetic expression selecting unit 103 is not limited to the method described above. Alternatively, the device can be constructed to determine a "meaning to be recalled" from text inputted as a subject when text data is the main text of a mail, or constructed to select a phonetic expression by determining whether or not a special character is used as a substitute for a character or characters in a "meaning to be recalled" by using a term detected from an entire series of text data inputted to the text input unit 13.

Figure 4:
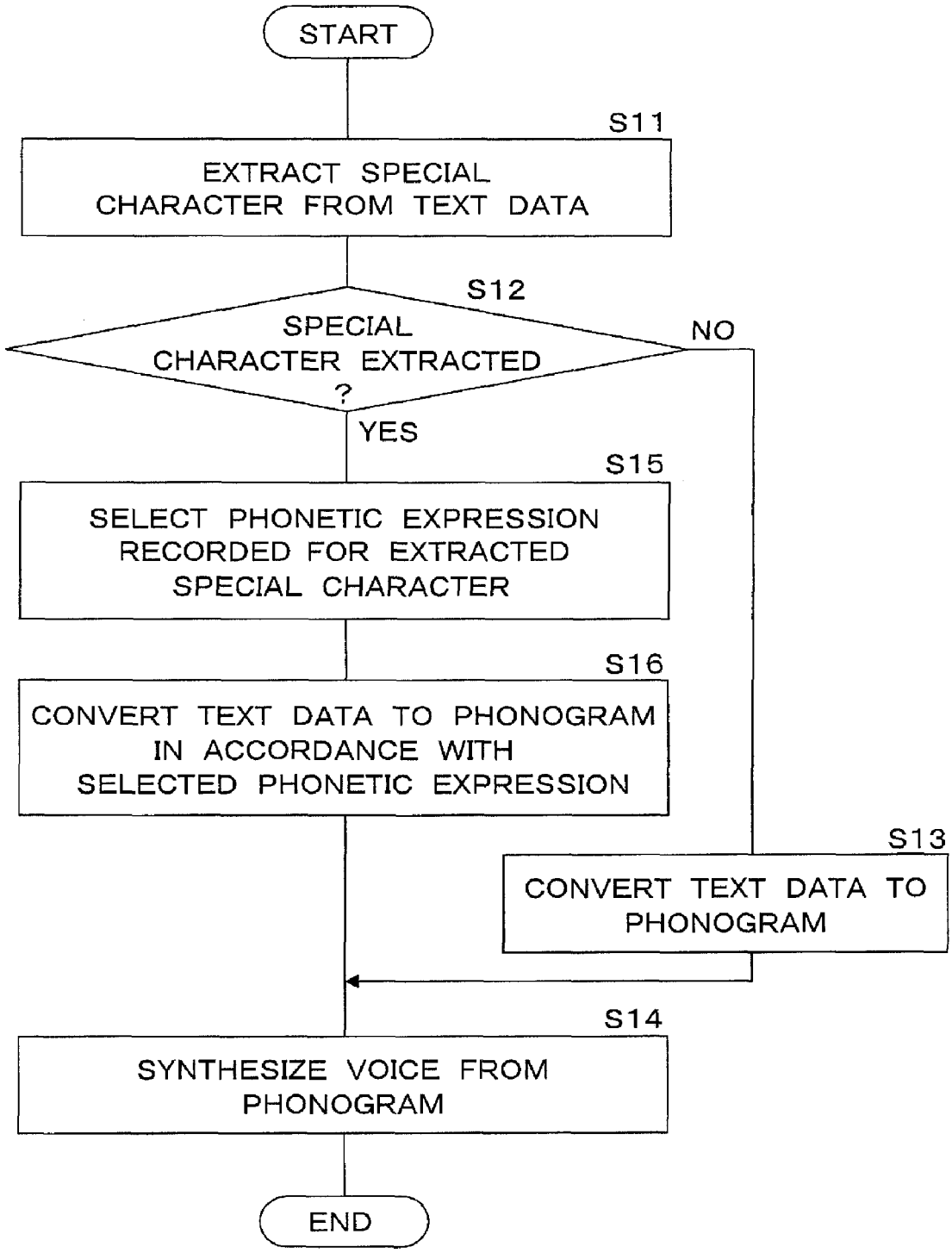
FIG. 4 is an example of an operation chart for illustrating the process procedure for synthesizing a voice from accepted text data by a control unit of a speech synthesizing device according to Embodiment 1.

FIG. 4 is an example of an operation chart for illustrating the process procedure for synthesizing a voice from accepted text data by a control unit 10 of a speech synthesizing device 1 according to Embodiment 1.

When receiving input of text data from the text input unit 13 with the function of the text accepting unit 101, the control unit 10 performs the following process.

The control unit 10 matches the received text data against an identification code registered in the special character dictionary 111 and performs a process to extract a special character (at operation S11). The control unit 10 determines whether or not a special character has been extracted at the operation S11 (at operation S12).

When it is determined at the operation S12 that a special character has not been extracted (at operation S12: NO), the control unit 10 converts the accepted text data to a phonogram by the function of the converting unit 104 (at operation S13). The control unit 10 synthesizes a voice with the function of the speech synthesizing unit 105 from the phonogram obtained through conversion (at operation S14) and terminates the process.

When it is determined at the operation S12 that a special character has been extracted (at operation S12: YES), the control unit 10 selects a phonetic expression, which is registered for the extracted special character, from the special character dictionary 111 (at operation S15). The control unit 10 converts the text data including a character string equivalent to the selected phonetic expression to a phonogram with the function of the converting unit 104 (at operation S16), synthesizes a voice by the function of the speech synthesizing unit 105 from the phonogram obtained through conversion (at operation S14) and terminates the process.

The process illustrated in the operation chart of FIG. 4 may be executed for each sentence when the received text data is not one sentence but text composed of a plurality of sentences, for example. Moreover, the device can be constructed to search the accepted text data from its top for an identification code of a special character and perform the process subsequent to the operation S13 on the searched part, and when the process to the operation S16 is completed, to perform the process to retrieve a next identification code and repeat the process to the searched part.

The following specific example is used to explain that the process of the control unit 10 of the speech synthesizing device 1 constructed as described above enables proper read-aloud of text data including a special character while inhibiting redundant read-aloud or read-aloud different from the intention of the user.

FIG. 5A and FIG. 5B are explanatory views for conceptually illustrating selection of a phonetic expression corresponding to a pictographic character performed by a control unit 10 of a speech synthesizing device 1 according to Embodiment 1. It is to be noted that the control unit 10 illustrated in the explanatory view of FIG. 5 selects a phonetic expression from phonetic expressions registered in the special character dictionary 111 illustrated in the explanatory view of FIG. 3.

In the example illustrated in FIG. 5A, text data including an illustrated special character and a special character reading is '"happy (HAPPI-) [Happy]"+"a pictographic character"' illustrated in the frame. When receiving the text data illustrated in FIG. 5A, the control unit 10 detects an identification code "XX" registered in the special character dictionary 111 from the text data and extracts a pictographic character.

The control unit 10 makes a language analysis of text data "happy (HAPPI-) [Happy]" excluding a part equivalent to the identification code "XX" of a pictographic character, detects a character code corresponding to each character of a character string "happy (HAPPI-) [Happy]" registered in the language dictionary 112, and recognizes a word "happy (HAPPI-) [happy]".

Next, the control unit 10 selects a phonetic expression for a pictographic character with an identification code "XX", which is an extracted special character, since a special character has been extracted from '"happy (HAPPI-) [Happy]"+"a pictographic character"'. The control unit 10 judges that the pictographic character with the identification code "XX" is equivalent to a noun, since the recognized "happy (HAPPI-) [Happy]" immediately before the pictographic character with the identification code "XX" is equivalent to a prenominal form an adjective and yet text data does not exist immediately after the special character. The control unit 10 selects Expression 1 on the basis of the classification of a phonetic expression illustrated in the explanatory view of FIG. 3, since the usage pattern is determined that a pictographic character equivalent to a noun is used as a substitute for a character. Furthermore, the control unit 10 determines that "happy (HAPPI-) [happy]" is used together with "birthday (BA-SUDE-) [birthday]" more frequently than with "candle (Rousoku) [candle]" by referring to the dictionary in which they are registered, and selects Candidate 1 as a meaning to be recalled from the design.

As described above, the control unit 10 replaces the special character with the selected phonetic expression of "birthday (BA-SUDE-)" and creates text data of "happy (HAPPI-) birthday (BA-SUDE-) [Happy birthday]". Then, by functioning as the converting unit 104, the control unit 10 makes a language analysis of text data of "happy (HAPPI-) birthday (BA-SUDE-) [Happy birthday]" and converts the text data to a phonogram "HAPPI-BA'-SUDE-(haepi be'rthdei)" by adding accent symbols.

On the other hand, text data including a special character illustrated in the frame of FIG. 5B is '"birthday (Otanjoubi) congratulations (Omedetou) [Happy birthday]"+"a pictographic character"'. When accepting the text data illustrated in FIG. 5B, the control unit 10 detects an identification code "XX" after a character code corresponding respectively to a character string "birthday (Otanjoubi) congratulations (Omedetou) [Happy birthday]" from the text data and extracts a pictographic character.

In the case of Japanese, the control unit 10 makes a language analysis of text data "birthday (Otanjoubi) congratulations (Omedetou)" excluding a part equivalent to an identification code of a pictographic character, detects a character code corresponding respectively to characters of a character string "birthday (Otanjoubi)" registered in the language dictionary 112 and recognizes a word "birthday (Otanjoubi)". Similarly, the control unit 10 detects a character code corresponding respectively to characters of a character string "congratulations (Omedetou)" registered in the language dictionary 112, and recognizes a word of "congratulations (Omedetou)".

In the case of English wherein a different word order is used even in an example having the same meaning, the control unit 10 makes a language analysis of text data "Happy birthday" excluding a part equivalent to an identification code of a pictographic character, detects a character code corresponding respectively to characters of a character string "Happy" registered in the language dictionary 112, and recognizes a word of "happy". Similarly, the control unit 10 detects a character code corresponding respectively to characters of a character string "birthday" registered in the language dictionary 112 and recognizes a word "birthday".

Since a special character has been extracted from '"birthday (Otanjoubi) congratulations (Omedetou) [Happy birthday]" + "a pictographic character"', the control unit 10 selects a phonetic expression of a pictographic character with an identification code "XX", which is the extracted special character. In the case of Japanese, "congratulations (Omedetou)" existing immediately before a pictographic character of the identification code "XX", which is recognized earlier is equivalent to a continuative form of an adjective or a noun (exclamation) and no text data exists immediately after the special character. Moreover, in the case of English, "birthday" existing immediately before a pictographic character of the identification code "XX", which is recognized earlier is a noun and no text data exists immediately after the special character. Since it is determined that the sentence ends immediately before the pictographic character with the identification code "XX" and the special character is used as something other than a substitute for a character or characters, the control unit 10 selects Expression 2 on the basis of the classification of a phonetic expression illustrated in the explanatory view of FIG. 3.

Furthermore, in the case of Japanese, the control unit 10 determines that "birthday (Otanjoubi)" detected from the text data has the same meaning as that of "birthday (BA-SUDE-)" registered as a reading of a phonetic expression by referring to a dictionary in which the reading is registered, and selects a phonetic expression of Candidate 1 as a meaning to be recalled from the design. When the text data is in English not in Japanese, the control unit 10 selects a phonetic expression of Candidate 1 as a meaning to be recalled from the design, since "birthday" detected from the text data coincides with "birthday" registered as a reading of a phonetic expression.

The control unit 10 replaces the special character with a phonetic expression "PACHIPACHI [clap-clap]" classified into Candidate 1 of the selected Expression 2 and creates text data "birthday (Otanjoubi) congratulations (Omedetou), PACHIPACHI [Happy birthday clap-clap]". Then, by functioning as the converting unit 104, the control unit 10 makes a language analysis of text data of "birthday (Otanjoubi) congratulations (Omedetou), PACHIPACHI [Happy birthday clap-clap]" and converts the text data to a phonogram "OTANJO'-BI, OMEDETO-, PA'CHIPA'CHI (haepi be'rthdei, klaep klaep)" by adding accent symbols and pause symbols.

By functioning as the speech synthesizing unit 105, the control unit 10 refers to the voice dictionary 113 on the basis of the phonogram "HAPPI-BA'-SUDE-(haepi be'rthdei)" or "OTANJO'-BI, OMEDETO-, PA'CHIPA'CHI (haepi be'rthdei, klaep klaep)" and synthesizes a voice. The control unit 10 gives the synthesized voice to the voice output unit 14 and outputs the voice.

In such a manner, with the speech synthesizing device 1 according to the present embodiment, '"happy (HAPPI-) [Happy]"+"a pictographic character"' illustrated in the example of the content of FIG. 5A is read by voice "happy (HAPPI-) birthday (BA-SUDE-) [Happy birthday]". Moreover, selected for '"birthday (Otanjoubi) congratulations (Omedetou) [Happy birthday]"+"a pictographic character"' illustrated in the example of the content of FIG. 5B is not a phonetic expression "birthday (BA-SUDE-) [birthday]" of a reading set for a pictographic character with an identification code "XX" but a phonetic expression "PACHIPACHI [clap-clap]", which is an imitative word or a sound effect. Accordingly '"birthday (Otanjoubi) congratulations (Omedetou) [Happy birthday]"+"a pictographic character"' illustrated in the example of the content of FIG. 5B is read aloud, "birthday (Otanjoubi) congratulations (Omedetou), PACHIPACHI [Happy birthday clap-clap]" by the speech synthesizing device 1 according to the present embodiment.

It is to be noted that the control unit 10 functioning as the speech synthesizing unit 105 registers the phonogram "PACHIPACHI [clap-clap]", "POKUPOKUCHI-N [flickering]" and the like obtained through conversion by the function of the converting unit 104 as a character string corresponding to a sound effect. When it is determined that a phonogram obtained through conversion includes a part coincident with a character string corresponding to a registered imitative word, the control unit 10 is constructed not only to synthesize a voice for a character string corresponding to an imitative word as a "reading" such as "PACHIPACHI [clap-clap]" and "POKUPOKUCHI-N [flickering]" but also to respectively synthesize a sound effect of "applause (Hakushu) [applause]" and a sound effect of "wooden fish (Mokugyo) and (To) singing bowl (Rin) [sound of lighting a match]".

With the speech synthesizing device 1 according to Embodiment 1, it is possible to extract a special character as described above, to determine classification of the special character from proximity text data, and to read aloud properly using a proper reading or a sound effect such as an imitative word.

It is to be noted that Embodiment 1 classifies a special character such as a pictographic character, a face mark or a symbol distinguished by one identification code or combination of identification codes, focusing on the fact that it is effective to use different phonetic expressions for a corresponding voice reading on the basis of whether the special character is used as a substitute for a character or as something other than a substitute for a character. With the speech synthesizing device 1 which is constructed to classify a phonetic expression for a special character and make it selectable as described above, it is possible to realize read-aloud suitable for a meaning and a usage pattern of a special character.

Classification of a special character stored in the memory unit 11 of the speech synthesizing device 1 is not limited to classification based on a meaning to be recalled from the design and indicating a usage pattern whether a special character is used as a substitute for a character or used as something other than a substitute for a character. For example, classification can be made on the basis of whether a special character represents a feeling (delight, anger, sorrow or pleasure) or a sound effect. Even when a phonetic expression for a special character is classified by a classification method different from classification in Embodiment 1, the speech synthesizing device 1 can determine a classification suitable for an extracted special character and read out the special character with a phonetic expression corresponding to the classification.

It is to be noted that the control unit 10 of the speech synthesizing device 1 may be constructed to select, when a phonetic expression of a special character inputted arbitrarily by the user is received together with accepting of text data including a special character, a phonetic expression accepted together and synthesize a voice in accordance with the selected phonetic expression without selecting a phonetic expression from the special character dictionary 111.

Furthermore, the device may be constructed in such a manner that a phonetic expression of a special character inputted by the user can be newly registered in the special character dictionary 111. In concrete terms, when accepting text data with the function of the text accepting unit 101, the control unit 10 of the speech synthesizing device 1 makes classification on the basis of a specific phonetic expression and the classification thereof (selection of Expression 1 or Expression 2) of a special character inputted through the text input unit 13 and registers the phonetic expression in the special character dictionary 111.

Figure 6:
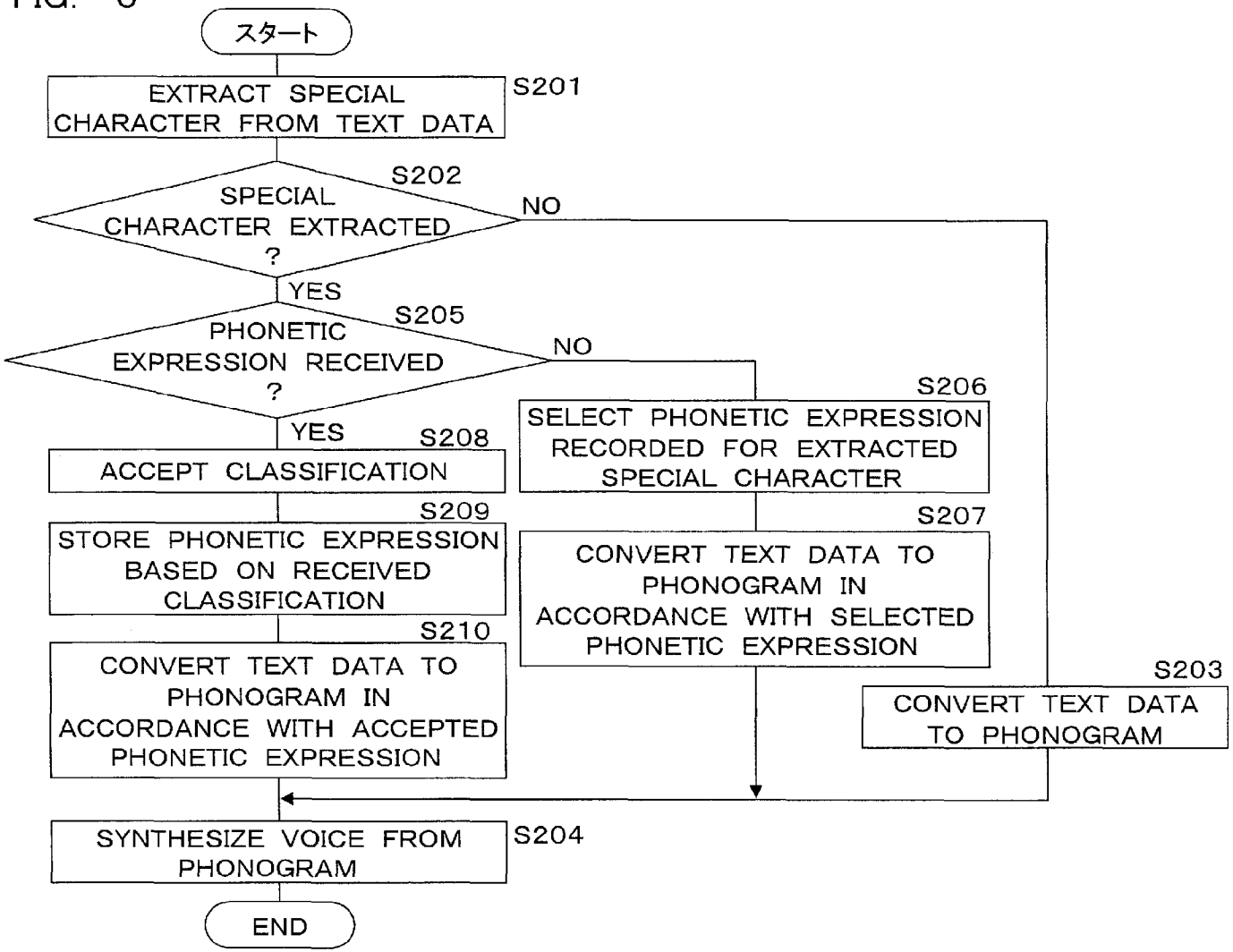
FIG. 6 is an example of an operation chart for illustrating the process procedure of a control unit of a speech synthesizing device according to Embodiment 1 for accepting a phonetic expression and classification of a special character, synthesizing a voice in accordance with the accepted phonetic expression and, furthermore, registering the accepted phonetic expression in a special character dictionary.

FIG. 6 is an example of an operation chart for illustrating the process procedure of a control unit 10 of a speech synthesizing device 1 according to Embodiment 1 for accepting a phonetic expression and classification of a special character, synthesizing a voice in accordance with the accepted phonetic expression and, furthermore, registering the accepted phonetic expression in a special character dictionary 111.

When accepting input of text data from the text input unit 13 with the function of the text accepting unit 101, the control unit 10 performs the following process.

The control unit 10 performs a process for matching the accepted text data against an identification code registered in the special character dictionary 111 and extracting a special character (at operation S201). The control unit 10 determines whether a special character has been extracted at the operation S201 or not (at operation S202).

When determining at the operation S22 that a special character has not been extracted (at operation S202: NO), the control unit 10 converts the accepted text data to a phonogram with the function of the converting unit 104 (at operation S203). The control unit 10 synthesizes a voice with the function of the speech synthesizing unit 105 from the phonogram obtained through conversion (at operation S204) and terminates the process.

When determining at the operation S202 that a special character has been extracted (at operation S202: YES), the control unit 10 determines whether a new phonetic expression of a special character has been accepted by the text input unit 13 or not (at operation S205).

When determining that a new phonetic expression has not been accepted (at operation S205: NO), the control unit selects a phonetic expression registered for the special character extracted from the special character dictionary 111 (at operation S206). The control unit 10 converts the text data including a character string equivalent to the selected phonetic expression to a phonogram with the function of the converting unit 104 (at operation S207), synthesizes a voice with the function of the speech synthesizing unit 105 from the phonogram obtained through conversion (at operation S204) and terminates the process.

When determining that a new phonetic expression has been received (at operation S205: YES), the control unit accepts classification of a new phonetic expression inputted together (at operation S208). Here, the user can select whether the usage pattern of the special character is a substitute for a character or characters, or "decoration", through the keyboard, the letter key the mouser or the like of the text input unit 13. By a receiving selection of the user through the text input unit 13, the control unit accepts the classification at the operation S208.

Next, the control unit stores the phonetic expression based on the classification accepted at the operation S208 in the special character dictionary 111 stored in the memory unit 11 (at operation S209), converts the text data to a phonogram with the function of the converting unit 104 in accordance with the new phonetic expression received at the operation S205 for the special character (at operation S210), synthesizes a voice with the function of the speech synthesizing unit 105 from the phonogram obtained through conversion (at operation S204) and terminates the process.

The process of the control unit 10 illustrated in the operation chart of FIG. 6 enables read-aloud of a special character in accordance with a phonetic expression in a meaning intended by the user. Furthermore, it is possible to store a new phonetic expression corresponding to a special character in the special character dictionary 111. When a plurality of other devices which are the same as the speech synthesizing device 1 exist, the speech synthesizing device 1 transmits received text data including a special character to another device together with the special character dictionary 111 storing the new phonetic expression, so that the text data can be read aloud by another device in a meaning intended by the user who input the text data.

A plurality of phonetic expressions of a particular character including a pictographic character, a face mark and a symbol are registered. Accordingly, it is possible to synthesize a voice by selecting any one phonetic expression from a plurality of registered phonetic expressions so that an expression method for outputting a particular character as a voice corresponds to a variety of patterns of usage of the particular character and a variety of meanings of the particular character. Therefore, it is possible to read aloud a particular character included in text not only as either a substitute for a character or a "decoration" but by arbitrarily selecting a phonetic expression depending on either one thereof or another usage pattern, and it is therefore possible to inhibit redundant read-aloud and read-aloud different from the intention of the user.

When a special character is extracted, it is possible to synthesize a voice by selecting any one phonetic expression depending on a usage pattern such as whether the special character is used as a substitute for a character or characters, or used as a "decoration", and/or in accordance with in which meaning of a variety of assumed meanings the special character is used. Accordingly redundant read-aloud of text including a special character and read-aloud different from the intention of the user are inhibited, and proper read-aloud suitable for the context of text represented by text data including a special character is realized.

A related terms are registered in association with a plurality of phonetic expressions registered in a dictionary respectively for special characters. When a related term is detected from the proximity of an extracted special character, a phonetic expression associated with the related term is selected as a phonetic expression of the extracted special character. By registering a term having a reading of a special character and a term having a meaning related to a special character as related terms, selection of a phonetic expression such as a reading and a sound effect in a meaning different from the intention of the user is prevented. As a result, it is possible to inhibit incorrect read-out. Furthermore, with the seventh embodiment wherein a term group which occurs together in the same context is associated as related terms, selection of a reading in a meaning different from the intention of the user is prevented.

Moreover, by registering a reading of each phonetic expression as a related term related to another phonetic expression, redundant read-out is inhibited since not a phonetic expression having the same reading but another phonetic expression is selected when a reading of one phonetic expression is detected from the proximity of a special character. That is, by registering both of a term for inhibiting read-aloud in a different meaning and a term for inhibiting read-aloud redundant with another phonetic expression as related terms, it becomes possible to inhibit both of read-aloud different from the intention of the user and redundant read-aloud depending only on whether a related term is detected or not, and it is possible to realize proper read-aloud.

It is possible to register a special character, which is newly defined, in a dictionary database. A phonetic expression of a reading of a special character is registered together with classification based on such as a usage pattern and/or a meaning of a special character, which is to be used for selecting the phonetic expression. Accordingly text data including a special character defined by the user can be read aloud true to the intention of the user who defines the special character. Moreover, by transmitting an updated dictionary database or dictionary update data only on special characters, which are newly defined in the dictionary database, together in transmitting text data including a special character, which is newly defined by the user, to another device, it becomes possible even for another device to realize read-aloud true to the intention of the user using the dictionary database.

Embodiment 2

In Embodiment 1, a phonetic expression registered in the special character dictionary 111 of the memory unit 11 of the speech synthesizing device 1 is classified into Expression 1 or Expression 2 on the basis of a pattern of the usage, i.e., whether a special character is used as a substitute for a character or characters, or used as something other than a substitute for a character or characters and is further classified into Candidate 1 or Candidate 2 on the basis of a meaning to be recalled from the special character. On the other hand, in Embodiment 2, classification of a pattern of usage as something other than a substitute for a character or characters is further detailed. In Embodiment 2, a phonetic expression is classified on the basis of whether a special character is used as a substitute for a character or characters, or used as something other than a substitute for a character or characters and, furthermore, when the special character is used as something other than a substitute for a character or characters on the basis of whether the special character is used as decoration for text especially with a reading intended or used as decoration for text especially in order to express the atmosphere of text.

Consequently, in Embodiment 2, for a special character which is used as decoration for text in order to express the atmosphere of text, not especially with a reading intended, BGM (Back Ground Music) is used as a corresponding a phonetic expression, instead of an imitative word or a sound effect.

Moreover, in Embodiment 1, the control unit 10 replaces a selected phonetic expression with an equivalent character string by functioning as the phonetic expression selecting unit 103 and converts text data including the character string used for replacement to a phonogram by functioning as the converting unit 104. On the other hand, in Embodiment 2, the control unit 10 performs conversion to a control character string representing the effect of a phonetic expression when a phonetic expression other than a reading such as sound effect or BGM is selected as a phonetic expression of a special character by the control unit 10 functioning as the converting unit 104.

Since the structure of a speech synthesizing device 1 according to Embodiment 2 is the same as that of the speech synthesizing device 1 according to Embodiment 1, detailed explanation thereof is omitted. In Embodiment 2, a special character dictionary 111 registered in a memory unit 11 of the speech synthesizing device 1 and conversion to a control character string by a converting unit 104 are different. Consequently, the same codes as those of Embodiment 1 are used and the following description will explain the special character dictionary 111 and conversion to a control character string with a specific example.

FIG. 7 is an explanatory view for illustrating an example of the content of the special character dictionary 111 stored in the memory unit 11 of the speech synthesizing device 1 according to Embodiment 2.

As illustrated in the explanatory view of FIG. 7, a pictographic character of an image of "three candles", for which an identification code "XX" is set, is registered as a special character in the special character dictionary 111. Six phonetic expressions are registered for the pictographic character of the image of "three candles". Regarding the phonetic expressions, BGM of "Happy birthday [Happy birthday]" and BGM of "Buddhist sutra" or "Ave Maria" are registered in addition to the phonetic expressions (see FIG. 3) registered in Embodiment 1.

Classification in Embodiment 2 illustrated in the explanatory view of FIG. 7 is made by Expression 2 and Expression 3, which are obtained by further categorizing a pattern (Expression 2) of usage as something other than a substitute for a character or characters in the classification (see FIG. 3) in Embodiment 1 into two.

As illustrated in the explanatory view of FIG. 7, a pictographic character for which an identification code "XX" is set is classified into Candidate 1 and Candidate 2 by a meaning, which recalls a birthday cake, or a meaning, which recalls a candle. Moreover, a pictographic character for which an identification code "XX" is set is classified into Expression 1, Expression 2 and Expression 3 by a usage pattern which indicates whether the special character is used as a substitute for a character or characters, used as something other than a substitute for a character or characters with a reading intended or used as something other than a substitute for a character or characters in order to express the atmosphere.

For a pictographic character with an identification code "XX", BGM of "Happy Birthday" is registered as a phonetic expression for the case where the pictographic character is used in a meaning, which recalls a birthday cake, and in order to express the atmosphere as illustrated in the explanatory view of FIG. 7. Moreover, BGM of "Buddhist sutra" ["Ave Maria"] which is to be associated with the case where candles are offered at the a alter (for Buddhism or Christianity) is registered as a phonetic expression for the case where the pictographic character is used in a meaning, which recalls candles, and in order to express the atmosphere.

The control unit 10 functions as the phonetic expression selecting unit 103, refers to the special character dictionary 111 in which a phonetic expression of a special character is classified and registered as illustrated in the explanatory view of FIG. 7, and selects a phonetic expression from a plurality of phonetic expressions corresponding to an extracted special character.

When functioning as the phonetic expression selecting unit 103, the control unit 10 determines a usage pattern which indicates whether a special character is used as a substitute for a character or characters, used as something other than a substitute for a character or characters with a reading intended or used as something other than a substitute for a character or characters in order to express the atmosphere. When accepted text data is in Japanese, for example, the control unit 10 determines the usage pattern as follows.

The control unit 10 makes a grammatical language analysis of text data in the proximity of a special character. When a special character is equivalent to a noun in word class information before and after the special character, the control unit 10 determines that the special character is used as a substitute for a character or characters and selects Expression 1. When a word classified as a prenominal form of an adjective is used immediately before a special character and there is a noun after the special character, the control unit 10 determines that the special character is used as something other than a substitute for a character or characters with a reading being intended and selects Expression 2. Moreover, when it is determined that a special character does not have a modification relation with a proximity word, the control unit 10 judges that the special character is used as something other than a substitute in order to express the atmosphere and selects BGM of Expression 3 as a phonetic expression corresponding to the special character.

When selecting Expression 3 and Candidate 1, i.e., BGM "Happy Birthday" illustrated in the explanatory view of FIG. 7 as a phonetic expression corresponding to a special character, the control unit 10 makes replacement with text data including a control character string to be used for outputting BGM during read-aloud of one sentence including the special character.

In concrete terms, when receiving text data of '"birthday (Otanjoubi) congratulations (Omedetou)"+"a pictographic character"' by functioning as a text accepting unit 101 and selecting BGM "Happy Birthday" as the phonetic expression selecting unit 103, the control unit 10 sandwiches the entire sentence including a special character with a control character string to be used for outputting BGM as follows. It is to be noted that Embodiment 2 will be explained by representing a control character string by a tag.

'<BGM "Happy Birthday"> birthday (Otanjoubi) congratulations (Omedetou) [Happy birthday]</BGM>'

When functioning as the converting unit 104, the control unit 10 performs conversion to a phonogram as follows with the tags left.

'<BGM "Happy Birthday">OTANJO'-BI, OMEDETO-(haepi be'rthdei)</BGM>'

When functioning as a speech synthesizing unit 105 and detecting a <BGM> tag in a phonogram, the control unit 10 reads out a voice file "Happy Birthday" described in the tag from a voice dictionary 113 during output of a phonogram sandwiched by the tags and outputs the voice file in a superposed manner.

Moreover, when selecting a phonetic expression "POKUPOKUCHI-N [flickering]" of Expression 2 and Candidate 2 illustrated in the explanatory view of FIG. 7 as a phonetic expression of a special character, the control unit 10 makes replacement with text data including, instead of a phonetic expression of a reading of an imitative word, a control character string to be used for outputting a sound effect of a wooden fish and a singing bowl [a sound of lighting a match] which is prerecorded.

In concrete terms, when receiving text data of '"Buddhist altar (Gobutsudan) [altar]"+"a pictographic character"' and selecting a sound effect of a wooden fish and a singing bowl [sound of lighting a match] as the phonetic expression selecting unit 103, the control unit 10 inserts a character string equivalent to a phonetic expression in which a special character is replaced as follows, that is, a control character string represented by a tag to be used for outputting a sound effect.

"Buddhist altar (Gobutsudan) [altar] <EFF>POKUPOKUCHI-N [flickering]</EFF>"

When functioning as the converting unit 104, the control unit 10 performs conversion to a phonogram as follows with the tags left.

"GOBUTSUDAN [ao'ltahr]<EFF>POKUPOKUCHI-N [flickering]</BGM>"

When functioning as the speech synthesizing unit 105 and detecting a <EFF> tag in the phonogram, the control unit 10 reads out a file sound effect "POKUPOKUCHI-N [flickering]" corresponding to a character string sandwiched by tags from the voice dictionary 113 and outputs the file.

Furthermore, when selecting Expression 2 and Candidate 1 illustrated in the explanatory view of FIG. 7, i.e., a phonetic expression "PACHIPACHI [clap-clap]" of an imitative word of applause as a phonetic expression of a special character, the control unit 10 converts "PACHIPACHI [clap-clap]" to a phonogram including a control character string to be used for outputting an imitative word with a masculine voice.

In concrete terms, when receiving text data of '"birthday (Otanjoubi) congratulations (Omedetou) [Happy birthday]"+"a pictographic character"' and selecting a phonetic expression "PACHIPACHI [clap-clap]", which is a sound effect, the control unit 10 as the phonetic expression selecting unit 103 inserts a character string equivalent to a phonetic expression, in which a special character is replaced as follows, i.e., a control character string represented by a tag to be used for outputting an imitative word in a masculine voice.

"birthday (Otanjoubi) congratulations (Omedetou) [Happy birthday]<M1>PACHIPACHI [clap -clap]</M1>"

When functioning as the converting unit 104, the control unit 10 performs conversion to a phonogram as follows with the tags left.

"OTANJO'-BI, OMEDETO-(haepi be'rthdei) <M1>PA'CHIPA'CHI [fli'kahring]</M1>"

When functioning as the speech synthesizing unit 105 and detecting a <M1> tag in the phonogram, the control unit 10 outputs a phonogram "PA'CHIPA'CHI [fli'kahring]" sandwiched by tags in a masculine voice.

It is to be noted that the control unit 10 may not necessarily be constructed to insert a control character string when functioning as the converting unit 104. When functioning as the phonetic expression selecting unit 103 and selecting a phonetic expression such as a sound effect or BGM, the control unit 10 makes replacement with a character string associated with the function of the speech synthesizing unit 105 preliminarily. When a phonetic expression "PACHIPACHI [clap-clap]" is selected, for example, the control unit 10 of the speech synthesizing device 1 operates as follows in order to output an applause sound which is prerecorded instead of reading as an imitative word. The control unit 10 functioning as the speech synthesizing unit 105 stores in the memory unit 11 a character string "HAKUSHUON [sound of applause]", which is associated with applause sound preliminarily so as to make the detectable. When selecting a phonetic expression "PACHIPACHI [clap-clap]", the control unit 10 replaces the special character in text data with a character string "HAKUSHUON [sound of applause]". The control unit 10 can match a phonogram against a stored character string "HAKUSHUON [sound of applause]", recognize a character string "HAKUSHUON [sound of applause]", and cause a voice output unit 14 to output a sound effect of applause [sound of applause] at a suitable point.

Moreover, the control unit 10 functions as the phonetic expression selecting unit 103 and stores the position of a special character in text data and a phonetic expression selected for the special character in a temporary storage area 12. In such a case, when functioning as the speech synthesizing unit 105, the control unit 10 may be constructed to read out the position of a special character in text data and the phonetic expression of the special character from the temporary storage area 12 and to create voice data in such a manner that sound effect or BGM is inserted at a proper place and outputted.

With Embodiment 2 which is constructed to classify and select a phonetic expression for a special character as illustrated in the explanatory view of FIG. 7, it is possible not only to inhibit redundant read-out or read-out which is not intended by the user but also to provide read-aloud in an expressive voice including an imitative word, a sound effect or BGM.

It is possible to register not only a phonetic expression of a reading corresponding to a special character but also any one of the phonetic expression of an imitative word, a sound effect, music and silence for synthesis, as phonetic expressions of a special character. Therefore, it is possible to realize effective read-aloud true to the intention of the user even when a special character is used not only as a substitute for a character or characters but also as "decoration".

Speech synthesizing unit for synthesizing a voice can recognize a phonetic expression of a special character by a plurality of methods such as recognition by a control character string or recognition by a selected phonetic expression itself and a position thereof. It is possible to realize effective read-aloud of a special character by performing conversion to a control character string in accordance with an existing rule for representing a selected phonetic expression and transmitting a control character string to existing speech synthesizing part which exists inside or to an outer device which is provided with existing speech synthesizing part. With a structure wherein speech synthesizing part can recognize a selected phonetic expression and a position thereof without using an existing rule of a control character string, it is also possible to realize effective read-aloud of a special character by transmitting and notifying a selected phonetic expression and the position thereof to speech synthesizing part which exists inside or an outer device which is provided with speech synthesizing part.

Embodiment 3

In Embodiment 3, related terms are registered in a special character dictionary 111 stored in a memory unit 11 of a speech synthesizing device 1 in association with each phonetic expression so as to be used by a control unit 10 functioning as a phonetic expression selecting unit 103 to select a phonetic expression.

Since the structure of the speech synthesizing device 1 according to Embodiment 3 is the same as that of the speech synthesizing device 1 according to Embodiment 1, detailed explanation thereof is omitted. In Embodiment 3, the special character dictionary 111 stored in the memory unit 11 of the speech synthesizing device 1 and the content of the process of the control unit 10 functioning as the phonetic expression selecting unit 103 are different from those of Embodiment 1. Accordingly the same codes as those of Embodiment 1 are used and the following description will explain the special character dictionary 111 and the process of the control unit 10 functioning as the phonetic expression selecting unit 103.

FIG. 8 is an explanatory view for illustrating an example of the content of the special character dictionary 111 to be stored in the memory unit 11 of the speech synthesizing device 1 according to Embodiment 3.

In the special character dictionary 111, a pictographic character of an image of "three candles", for which an identification code "XX" is set, is registered as a special character as illustrated in the explanatory view of FIG. 8. Four phonetic expressions are registered for the pictographic character of the image of "three candles". A phonetic expression and classification of each phonetic expression in Embodiment 3 illustrated in the explanatory view of FIG. 8 are the same as classification (see FIG. 3) in Embodiment 1.

As illustrated in the explanatory view of FIG. 8, one or a plurality of related terms are registered in the special character dictionary 111 in association with each phonetic expression. This is for selecting a phonetic expression, with which a related term is associated, when a related term exists in the proximity of a special character.

In the example illustrated in the explanatory view of FIG. 8, "happy (HAPPI-) [happy]", which has a strong connection with a phonetic expression "birthday (BA-SUDE-) [birthday]" of a reading is registered in the special character dictionary 111 as a related term. Accordingly the speech synthesizing device 1 selects a phonetic expression "birthday (BA-SUDE-) [birthday]" of a reading, with which "happy (HAPPI-) [happy]" is associated, when a special character of an identification code "XX" exists in accepted text data and, furthermore, a related term "happy (HAPPI-) [happy]" exists in the proximity of, especially immediately before, the special character. The speech synthesizing device 1 can read out text data '"happy (HAPPI-) [Happy]"+"a pictographic character"' including a special character as "happy (HAPPI-) birthday (BA-SUDE-) [Happy birthday]".

Moreover, the underline in the explanatory view of FIG. 8 indicates that "PACHIPACHI [clap]", which is a reading of a phonetic expression having the same meaning to be recalled and belonging to different classification of a usage pattern, is registered in the special character dictionary 111 in association with a phonetic expression "birthday (BA-SUDE-) [birthday]" of a reading. This is allowing the speech synthesizing device 1 to select and read out a phonetic expression "birthday (BA-SUDE-) [birthday]" of a reading belonging to classification having the same meaning to be recalled, since read-aloud of a special character as "PACHIPACHI [clap-clap]" becomes redundant read-aloud when a special character with an identification code "XX" exists in text data accepted by the speech synthesizing device 1 and a related term "PACHIPACHI [clap]" exists in the proximity of the special character.

A related term "applause (Hakushu) [applause]" is registered in the special character dictionary 111 in association with a phonetic expression "PACHIPACHI [clap-clap]", which is a reading of an imitative word or a sound effect. In such a manner, the speech synthesizing device 1 selects a phonetic expression "PACHIPACHI [clap-clap]" associated with "applause (Hakushu) [applause]" when a special character with an identification code "XX" exists in text data and "applause (Hakushu) [applause]" exists in the proximity of the special character.

Similarly the underline in the explanatory view of FIG. 8 indicates that "birthday (BA-SUDE-) [birthday]", which is a reading of a phonetic expression that has the same meaning to be recalled and belongs to different classification of a usage pattern, is registered in the special character dictionary 111 in association with a phonetic expression "PACHIPACHI [clap-clap]" of a reading of an imitative word or a sound effect. Moreover, related terms "Buddhist altar (Butsudan) [altar]" and "blackout (Teiden) [blackout]" are registered in the special character dictionary 111 in association with a phonetic expression "candle (Rousoku) [candles]" of a reading. Moreover, a related term "POKUPOKUCHI-N [flick]" is registered in the special character dictionary 111 in association with a phonetic expression "candle (Rousoku) [candles]" of a reading in order to prevent the speech synthesizing device 1 from performing redundant read-aloud of a phonetic expression "POKUPOKUCHI-N [flickering]" of a reading of an imitative word or a sound effect, which has the same meaning to be recalled as "candle (Rousoku) [candles]" and belongs to different classification of a usage pattern.

Accordingly, when a special character with an identification code "XX" exists in text data and "Buddhist altar (Butsudan) [altar]", "blackout (Teiden) [blackout]" or "POKUPOKUCHI-N [flick]" exists in the proximity of the special character, the control unit 10 of the speech synthesizing device 1 selects a phonetic expression "candle (Rousoku) [candles]" of a reading.

Furthermore, related terms "wooden fish (Mokugyo)" and "singing bowl (Rin)" ["pray" ] are registered in the special character dictionary 111 in association with a phonetic expression "POKUPOKUCHI-N [flickering]" of a reading of an imitative word or a sound effect. Moreover, a related term "candle (Rousoku) [candles]" is registered in the special character dictionary 111 in association with a phonetic expression "POKUPOKUCHI-N" of a reading of an imitative word or a sound effect in order to prevent the speech synthesizing device 1 from redundantly reading-out a phonetic expression "candle (Rousoku) [candles]" of a reading, which has the same meaning to be recalled as "POKUPOKUCHI-N [flickering]" and belongs to different classification of a usage pattern.

Accordingly, when a special character of an identification code "XX" exists in text data and "wooden fish (Mokugyo)" or "singing bowl (Rin)" ["pray" ] or "candle (Rousoku) [candles]" exists in the proximity of the special character, the control unit 10 of the speech synthesizing device 1 selects a phonetic expression "POKUPOKUCHI-N [flickering]" of a reading of an imitative word or a sound effect.

The following description will explain the process of the control unit 10 of the speech synthesizing device 1 for selecting a phonetic expression registered in the special character dictionary 111 using a related term registered in the special character dictionary 111 as illustrated in the explanatory view of FIG. 8.

Figure 9A:
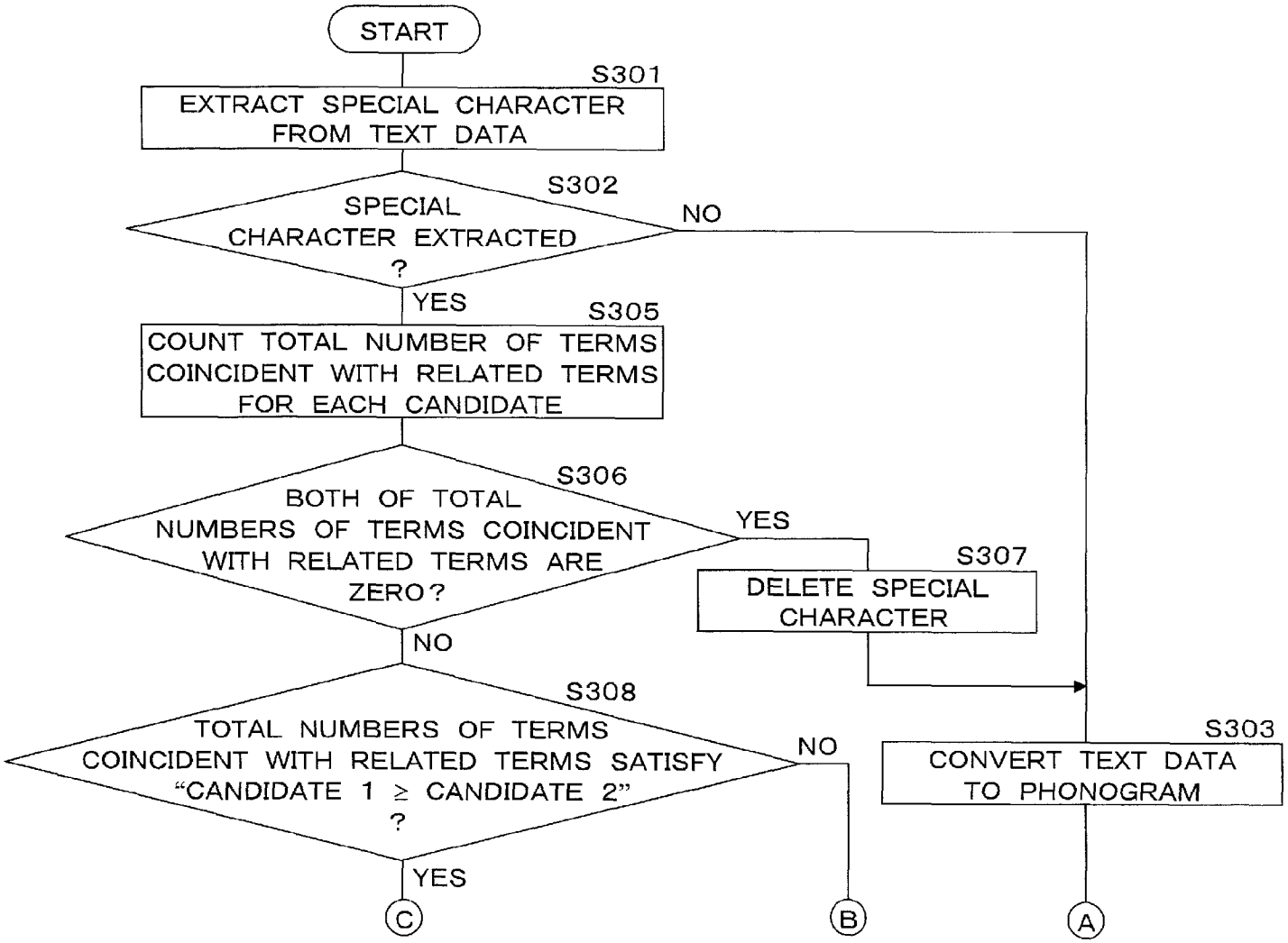
FIG. 9A and FIG. 9B are operation charts for illustrating the process procedure of a control unit of a speech synthesizing device according to Embodiment 3 for synthesizing a voice from accepted text data.
Figure 9B:
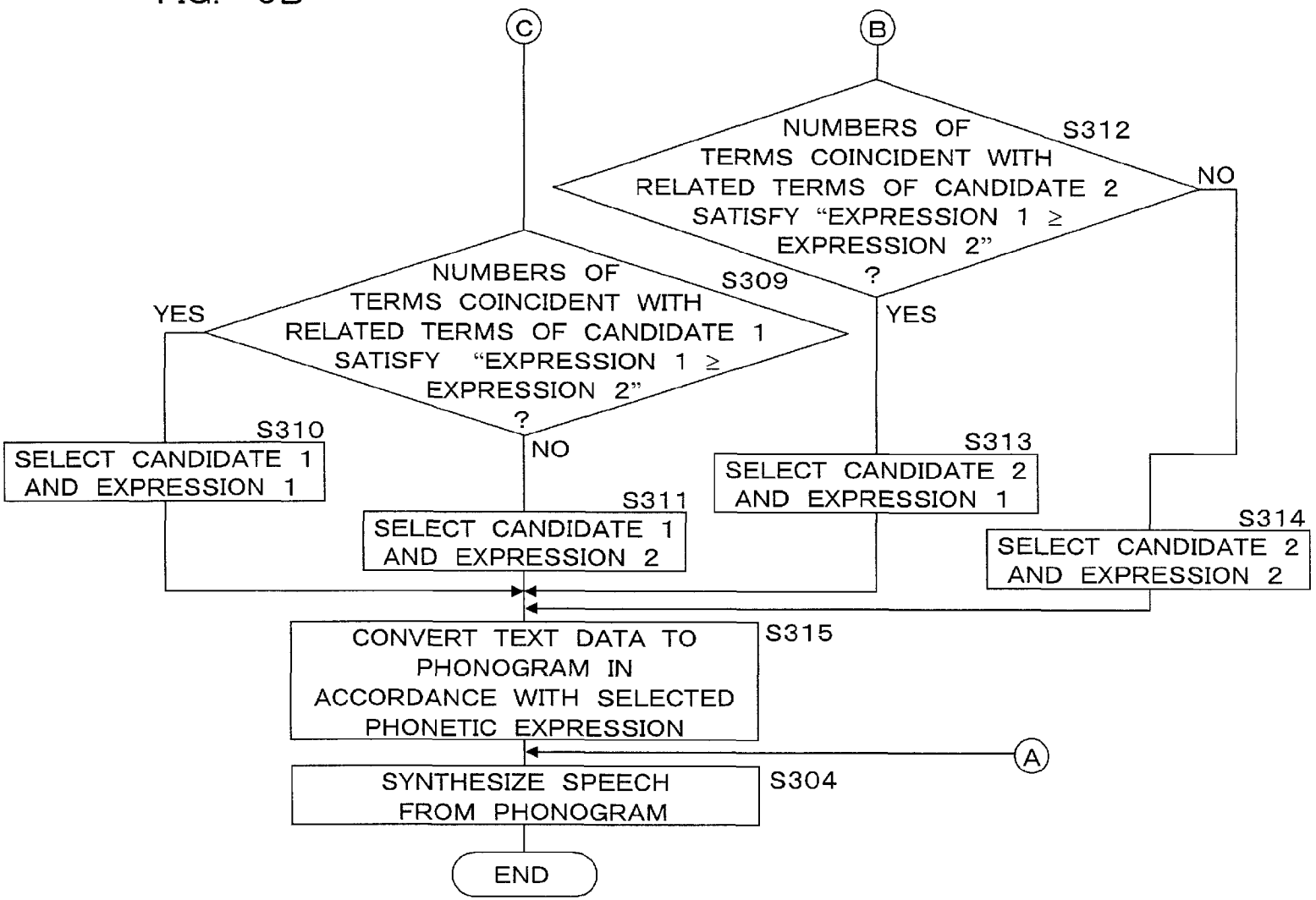

FIG. 9A and FIG. 9B are an operation chart for illustrating the process procedure of the control unit 10 of the speech synthesizing device 1 according to Embodiment 3 for synthesizing a voice from accepted text data.

When accepting input of text from a text input unit 13 by the function of an accepting unit 101, the control unit 10 performs the following process.

Here, for ease of explanation, the number of terms in text data coincident with related terms associated with Expression 1 among related terms associated with a phonetic expression of Candidate 1 is represented by Nc1$r$1. Moreover, the number of terms in text data coincident with related terms associated with Expression 2 among related terms associated with a phonetic expression of Candidate 1 is represented by Nc1$r$2. When the total number of terms in text data coincident with related terms associated with a phonetic expression of Candidate 1 is represented by Nc1, an equation Nc1=Nc1$r$1+Nc1$r$2 is satisfied. On the other hand, the number of terms in text data coincident with related terms associated with Expression 1 among related terms associated with a phonetic expression of Candidate 2 is represented by Nc2$r$1. Moreover, the number of terms in text data coincident with related terms associated with Expression 2 among related terms associated with a phonetic expression of Candidate 2 is represented by Nc2$r$2. When the total number of terms in text data coincident with related terms associated with a phonetic expression of Candidate 2 is represented by Nc2, an equation Nc2=Nc2$r$1+Nc2$r$2 is satisfied.

The control unit 10 matches the accepted text data against an identification code registered in the special character dictionary 111 and extracts a special character (at operation S301). The control unit 10 determines whether a special character has been extracted at the operation S301 or not (at operation S302).

When determining at the operation S302 that a special character has not been extracted (at operation S302: NO), the control unit 10 converts the accepted text data to a phonogram with the function of a converting unit 104 (at operation S303). The control unit 10 synthesizes a voice with the function of a speech synthesizing unit 105 from the phonogram obtained through conversion (at operation S304) and terminates the process.

When determining at the operation S302 that a special character has been extracted (at operation S302: YES), the control unit 10 counts the total number (Nc1) of terms in accepted text data coincident with related terms associated with a phonetic expression of Candidate 1 registered in the special character dictionary 111 for the extracted special character, and the total number (Nc2) of terms in accepted text data coincident with related terms associated with a phonetic expression of Candidate 2, for each candidate (at operation S305).

The control unit 10 determines whether both of the total number of terms coincident with related terms associated with a phonetic expression of Candidate 1 and the total number of terms coincident with related terms associated with a phonetic expression of Candidate 2, which are counted at the operation S305, are zero or not (Nc1=Nc2=0?) (at operation S306). When determining that both of the total numbers of coincident terms for Candidate 1 and Candidate 2 are zero (at operation S306: YES), the control unit 10 deletes the extracted special character (at operation S307). It is to be noted that deletion of a special character at the operation S307 is equivalent to selection of not to read aloud the special character, that is, to select "silence" as a phonetic expression corresponding to the special character. Then, the control unit 10 converts the rest of the text data to a phonogram with the function of the converting unit 104 (at the operation S303), synthesizes a voice with the function of the speech synthesizing unit 105 from the phonogram obtained through conversion (at the operation S304) and terminates the process.

When determining at the operation S306 that any one of the total number of terms coincident with related terms associated with a phonetic expression of Candidate 1 and a phonetic expression of Candidate 2 is not zero (at the operation S306: NO), the control unit 10 determines whether the total number of terms coincident with related terms associated with a phonetic expression of Candidate 1 is larger than or equal to the total number of terms coincident with related terms associated with a phonetic expression of Candidate 2 or not (Nc1≧Nc2?) (at operation S308).

The reason for comparing the total numbers of terms coincident with related terms between Candidate 1 and Candidate 2 at the operation S308 with the control unit 10 is as follows. Candidate 1 and Candidate 2 are classified by a difference in a meaning to be recalled from the design of a special character, and a related term is also classified into Candidate 1 and Candidate 2 by a difference in a meaning. Accordingly, it can be determined that an extracted special character is used in a meaning closer to that of Candidate 1 or Candidate 2, for which more related terms are detected from the proximity of a special character.

When determining at the operation S308 that the total number of terms coincident with related terms associated with a phonetic expression of Candidate 1 is larger than or equal to the total number of terms coincident with related terms associated with a phonetic expression of Candidate 2 (at the operation S308: YES), the control unit 10 determines whether or not the number (Nc1*r*1) of terms coincident with related terms associated with a phonetic expression of Expression 1 among related terms associated with a phonetic expression of Candidate 1 is larger than or equal to the number (Nc1*r*2) of terms coincident with related terms associated with a phonetic expression of Expression 2 (Nc1*r*1≧Nc1*r*2?) (at operation S309).

The reason for the control unit 10 to compare the total number of terms coincident with related terms for Expression 1 and Expression 2, which recall the same meaning, at the operation S309 is as follows. Since a related term is registered so that a phonetic expression of associated Expression 1 or Expression is selected when the related term is detected, an associated phonetic expression is selected when more associated related terms are detected from the proximity of a special character.

Accordingly, when determining at the operation S309 that the number (Nc1*r*1) of terms coincident with related terms associated with a phonetic expression of Expression 1 of Candidate 1 is larger than or equal to the number (Nc1*r*2) of terms coincident with related terms associated with a phonetic expression of Expression 2 of Candidate 1 (Nc1*r*1≧Nc1*r*2) (at the operation S309: YES), the control unit 10 selects a phonetic expression classified into Candidate 1 and Expression 1 (at operation S310).

On the other hand, when determining at the operation S309 that the number (Nc1*r*1) of terms coincident with related terms associated with a phonetic expression of Expression 1 is smaller than the number (Nc1*r*2) of terms coincident with related terms associated with a phonetic expression of Expression 2 (Nc1*r*1<Nc1*r*2) (at the operation S309: NO), the control unit 10 selects a phonetic expression classified into Candidate 1 and Expression 2 (at operation S311).

Moreover, when determining at the operation S308 that the total number (Nc1) of terms coincident with related terms associated with a phonetic expression of Candidate 1 is smaller than the total number (Nc2) of terms coincident with a related term associated with a phonetic expression of Candidate 2 (Nc1<Nc2) (at the operation S308: NO), the control unit 10 determines whether or not the number (Nc2*r*1) of terms coincident with related terms associated with a phonetic expression of Expression 1 among related terms associated with a phonetic expression of Candidate 2 is larger than or equal to the number (Nc2*r*2) of terms coincident with related terms associated with a phonetic expression of Expression 2 (Nc2*r*1≧Nc2*r*2?) (at operation S312).

When determining at the operation S312 that the number (Nc2*r*1) of terms coincident with related terms associated with a phonetic expression of Expression 1 of Candidate 2 is larger than or equal to the number (Nc2*r*2) of terms coincident with related terms associated with a phonetic expression of Expression 2 of Candidate 2 (Nc2*r*1≧Nc2*r*2) (at the operation S312: YES), the control unit 10 selects a phonetic expression classified into Candidate 2 and Expression 1 (at operation S313).

When determining at the operation S312 that the number (Nc2*r*1) of terms coincident with related terms associated with a phonetic expression of Expression 1 of Candidate 2 is smaller than the number (Nc2*r*2) of terms coincident with related terms associated with a phonetic expression of Expression 2 of Candidate 2 (Nc2*r*1<Nc2*r*2) (at the operation S312: NO), the control unit 10 selects a phonetic expression classified into Candidate 2 and Expression 2 (at operation S314).

The control unit 10 converts the text data including a special character to a phonogram with the function of the converting unit 104 in accordance with a phonetic expression selected in the steps S310, S311, S313 and S314 (at operation S315).

The control unit 10 synthesizes a voice with the function of the speech synthesizing unit 105 from the phonogram obtained through conversion (at the operation S304) and terminates the process.

The process illustrated in the flowchart of FIG. 9A and FIG. 9B may be executed for each sentence when text data is not one sentence but text composed of a plurality of sentences, for example. Accordingly the number of terms coincident with related terms in text data is counted at the operation S305 assuming that the area in text data equivalent to one sentence including the special character is the proximity of the special character. However, the number of coincident related terms may be counted assuming that not only text data equivalent to one sentence but text data equivalent to a plurality of sentences before and after the sentence including a special character is the proximity of the special character.

Furthermore, when text data is provided with accessory text such as the subject, the number of related terms may be counted in the accessory text. Here, when a special character is included also in the accessory text, it is unnecessary to make an analysis such as whether the special character is equivalent to a related term or not.

By the process procedure illustrated in the operation chart of FIG. 9A and FIG. 9B, a phonetic expression for which more associated related terms coincide is selected for an extracted special character. In such a manner, it is possible to inhibit read-aloud in a meaning different from the intention of the user and redundant read-aloud. Accordingly, it is possible to realize proper read-aloud intended by the user.

It is to be noted that in Embodiment 3 a term group having a good possibility of co-occurrence with a reading of a phonetic expression may be registered in a database as related terms in association respectively with phonetic expressions. When a term group having a good possibility of co-occurrence with a phonetic expression including a reading for a special character is detected from the proximity of the special character, it is considered that the meaning to be recalled visually by the special character is similar. Accordingly it is possible to inhibit read-aloud which recalls a meaning different from the intention of the user caused by misunderstanding of the meaning of the special character.

A synonymous term having substantially the same reading or meaning with a meaning of a phonetic expression in use is registered in association with each of plurality of phonetic expressions registered in association with a special character. When a synonymous term is detected from the proximity of a special character, a phonetic expression other than a phonetic expression with which the synonymous term is associated is selected. Since another phonetic expression is selected so that a phonetic expression, which has the same reading as, or substantially the same meaning as, a synonymous term detected from the proximity of a special character, is not read aloud, it is possible to inhibit redundant read-aloud.

When accessory text such as the subject exists with text data, it is possible to determine a meaning corresponding to a special character more accurately by referring to the accessory text.

Embodiment 4

In Embodiment 4, a related term and a synonymous term are registered in a special character dictionary 111 stored in a memory unit 11 of a speech synthesizing device 1 in association respectively with phonetic expressions, so as to be used when a control unit 10 as a phonetic expression selecting unit 103 selects a phonetic expression for a special character.

Since the structure of the speech synthesizing device 1 according to Embodiment 4 is the same as that of the speech synthesizing device 1 according to Embodiment 1, detailed explanation thereof is omitted. In Embodiment 4, since the special character dictionary 111 stored in the memory unit 11 of the speech synthesizing device 1 and the content of the process of the control unit 10 functioning as the phonetic expression selecting unit 103 are different, the special character dictionary 111 and the process of the control unit 10 functioning as the phonetic expression selecting unit 103 will be explained below using the same codes as those of Embodiment 1.

FIG. 10 is an explanatory view for illustrating an example of the content of the special character dictionary 111 to be stored in the memory unit 11 of the speech synthesizing device 1 according to Embodiment 4.

As illustrated in the explanatory view of FIG. 10, a pictographic character of an image of "three candles", for which an identification code "XX" is set, is registered in the special character dictionary 111 as a special character. Six phonetic expressions are registered for the pictographic character of the image of "three candles". The phonetic expressions and classification of each phonetic expression in Embodiment 4 illustrated in the explanatory view of FIG. 10 are the same as classification (see FIG. 7) in Embodiment 2.

As illustrated in the explanatory view of FIG. 10, one or a plurality of related terms and synonymous terms are registered in the special character dictionary 111 in association respectively with each phonetic expression. Regarding a related term, it is used to select a phonetic expression associated with a related term when a related term exists in the proximity of a special character. On the other hand, regarding a synonymous term, it is used not to select a phonetic expression associated with a synonymous term in order to inhibit redundant read-aloud when a synonymous term exists in the proximity of a special character.

In the example illustrated in the explanatory view of FIG. 10, synonymous terms "birthday (BA-SUDE-)" and "birthday (Tanjoubi)" ["birthday" ] are registered in the special character dictionary 111 in association with a phonetic expression "birthday (BA-SUDE-) [birthday]" of a reading. This is because read-aloud of a special character as "birthday (BA-SUDE-) [birthday]" becomes redundant read-aloud when "birthday (BA-SUDE-)" or "birthday (Tanjoubi)" ["birthday" ] exists in the proximity of the special character with an identification code "XX" included in text data. In such a manner, the speech synthesizing device 1 can be constructed not to read aloud "birthday (BA-SUDE-) [birthday]" when a special character with an identification code "XX" exists in accepted text data and a character string "birthday (BA-SUDE-) [birthday]" exists in the proximity the special character.

Moreover, "happy (HAPPI-) [happy]" is registered in the special character dictionary 111 as a related term in association with a phonetic expression "birthday (BA-SUDE-) [birthday]" of a reading. By registering "happy (HAPPI-) [happy]" as a related term corresponding to a phonetic expression "birthday (BA-SUDE-) [birthday]" of a reading, the speech synthesizing device 1 selects a phonetic expression "birthday (BA-SUDE-) [birthday]" of a reading associated with a related term "happy (HAPPI-)" when a special character with an identification code "XX" exists in accepted text data and a character string "happy (HAPPI-)" exists in the proximity of the special character. In such a manner, the speech synthesizing device 1 can read out text data including a special character as "happy (HAPPI-) birthday (BA-SUDE-) [birthday]".

A synonymous term "PACHIPACHI [clap]" is registered in the special character dictionary 111 in association with a phonetic expression "PACHIPACHI [clap-clap]" of a reading of an imitative word or a sound effect. Moreover, a related term "applause (Hakushu) [applause]" is registered in the special character dictionary 111 in association with a phonetic expression "PACHIPACHI [clap-clap]" of a reading of an imitative word or a sound effect. Accordingly, when a special character of an identification code "XX" exists in received text data and a character string "applause (Hakushu) [applause]" exists in the proximity of the special character, the speech synthesizing device 1 can select a phonetic expression "PACHIPACHI [clap-clap]" associated with "applause (Hakushu) [applause]" and read aloud text data including a special character as, for example, "applause (Hakushu), PACHIPACHI [give a sound of applause, clap clap]".

Similarly a synonymous term "candle (Rousoku) [candles]" is registered in the special character dictionary 111 in association with a phonetic expression "candle (Rousoku) [candles]" of a reading. Moreover, related terms "Buddhist altar (Butsudan) [altar]" and "blackout (Teiden) [blackout]" are registered in association with a phonetic expression "candle (Rousoku) [candles]" of a reading.

Furthermore, synonymous terms "POKUPOKU" and "CHI-N" ["flick", "glitter" and "twinkle" ] are registered in the special character dictionary 111 in association with a phonetic expression "POKUPOKUCHI-N [flickering]" of a reading of an imitative word or a sound effect. Furthermore, related terms "wooden fish (Mokugyo)" and "singing bowl (Rin)" ["pray" ] are registered in association with a phonetic expression "POKUPOKUCHI-N" of a reading of an imitative word or a sound effect.

The following description will explain the process performed by the control unit 10 of the speech synthesizing device 1 for selecting a phonetic expression registered in the special character dictionary 111 using a related term registered in the special character dictionary 111 as illustrated in the explanatory view of FIG. 10.

Figure 11A:
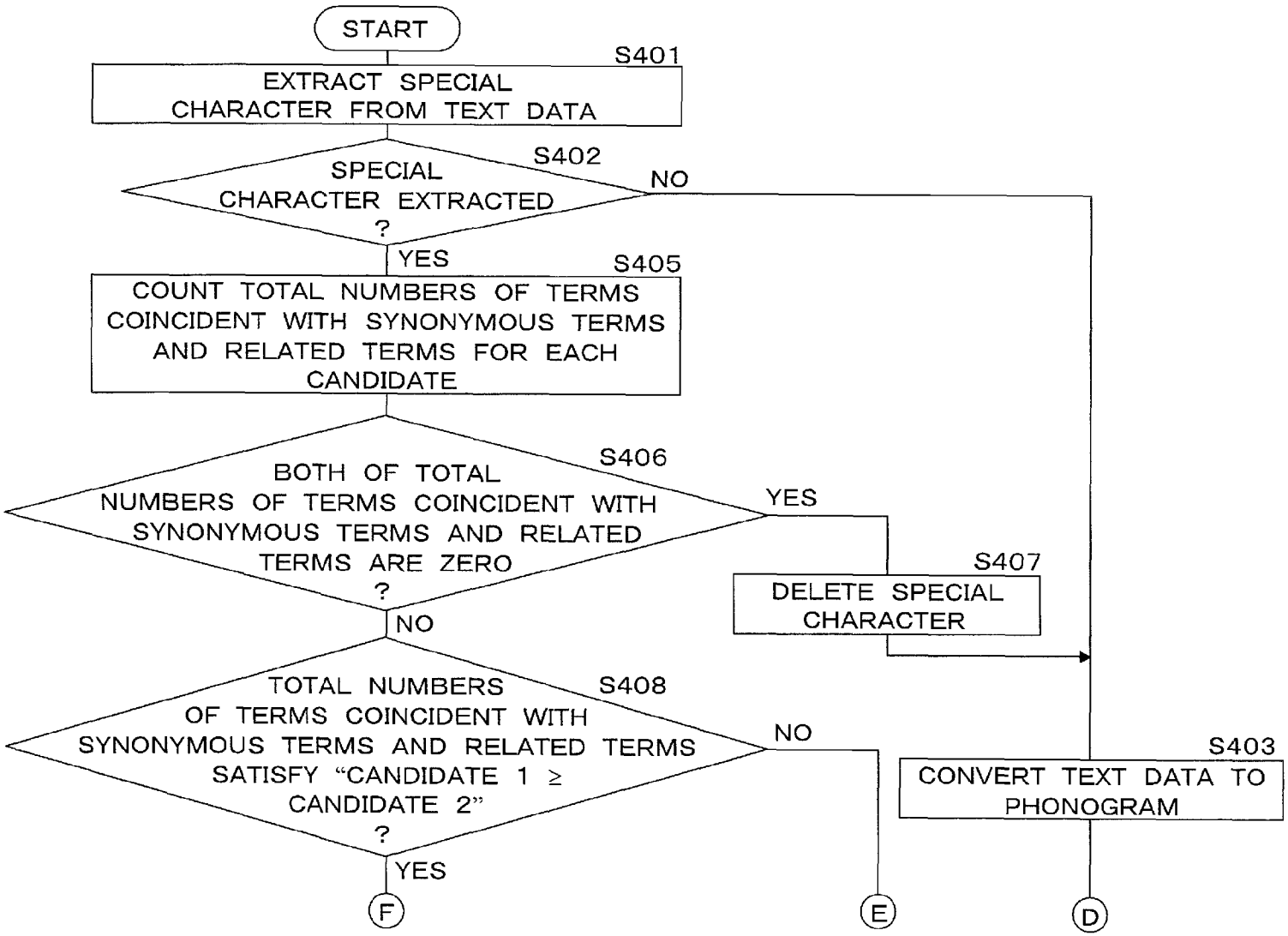
FIGS. 11A, 11B and 11C are operation charts for illustrating the process procedure for synthesizing a voice from accepted text data performed by a control unit of a speech synthesizing device according to Embodiment 4.
Figure 11B:
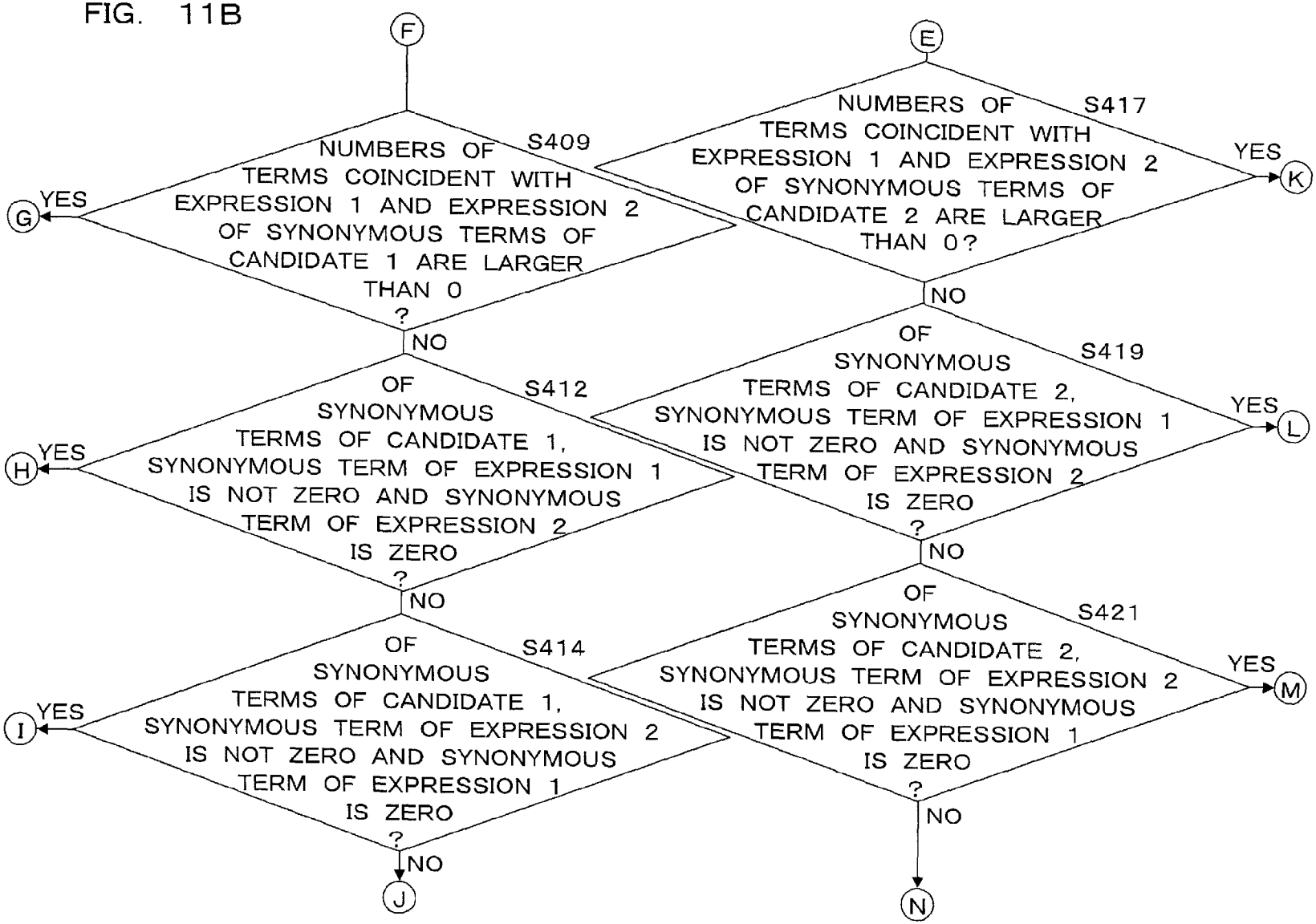
Figure 11C:
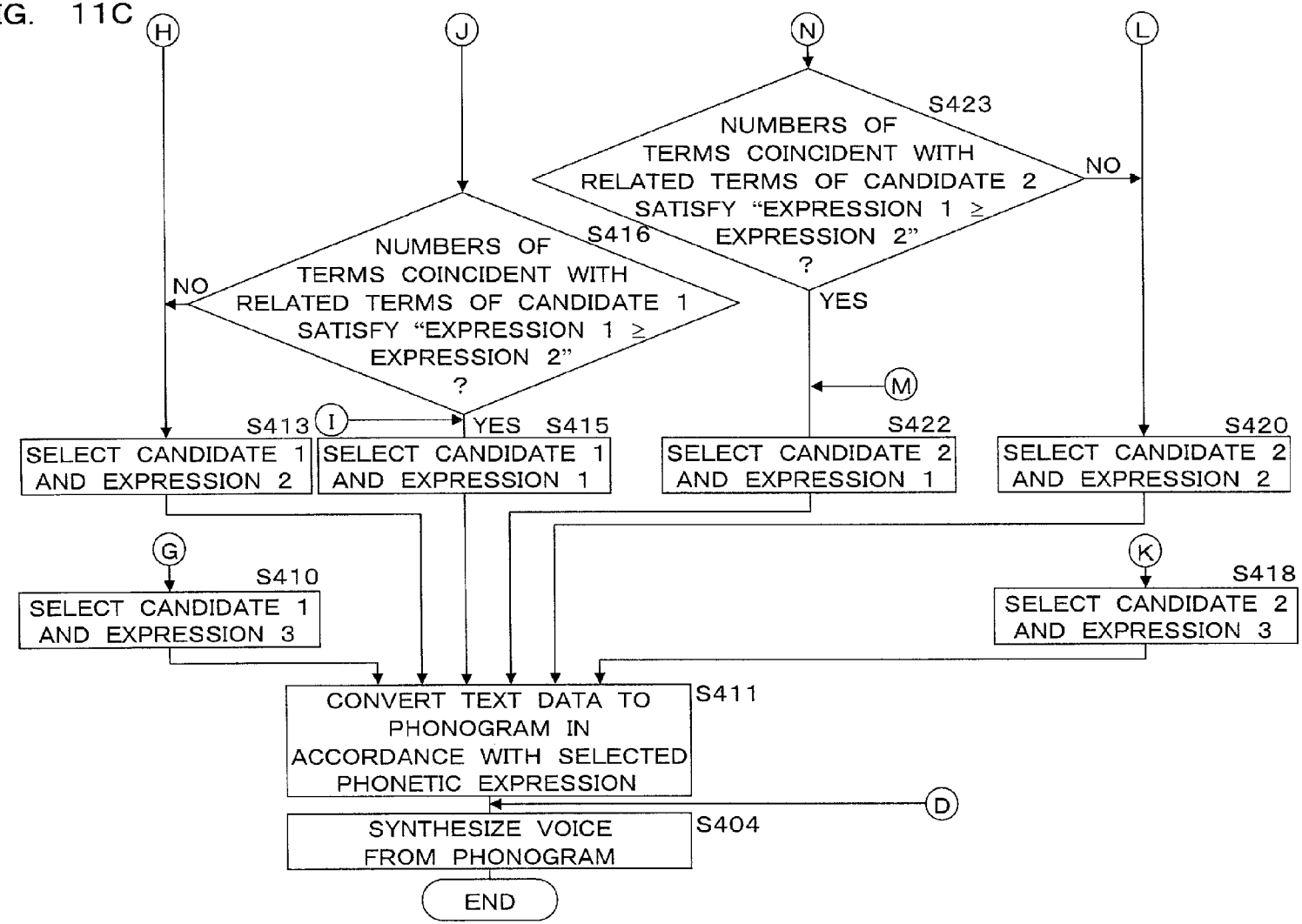

FIGS. 11A, 11B and 11C are an operation chart for illustrating the process procedure for synthesizing a voice from accepted text data performed by the control unit 10 of the speech synthesizing device 1 according to Embodiment 4. It is to be noted that, since the process from the operation S401 to the operation S404 in the process procedure illustrated in the operation chart of FIGS. 11A, 11B and 11C are the same process as the process from the operation S301 to the operation S304 in the process procedure illustrated in the operation chart of FIGS. 9A and 9B in Embodiment 3, detailed explanation thereof is omitted and the following description will explain the process after the operation S405.

Here, for ease of explanation, the number of terms in text data coincident with synonymous terms associated with Expression 1 among synonymous terms and related terms associated with a phonetic expression of Candidate 1 is represented by Nc1*s*1. The number of terms in text data coincident with synonymous terms associated with Expression 2 among synonymous terms and related terms associated with a phonetic expression of Candidate 1 is represented by Nc1*s*2. The number of terms in text data coincident with related terms associated with Expression 1 among synonymous terms and related terms associated with a phonetic expression of Candidate 1 is represented by Nc1*r*1. The number of terms in text data coincident with related terms associated with Expression 2 among synonymous terms and related terms associated with a phonetic expression of Candidate 1 is represented by Nc1*r*2.

When the total number of terms in text data coincident with related terms associated with a phonetic expression of Candidate 1 is represented by N1, an equation N1=Nc1*s*1+Nc1*s*2+Nc1*r*1+Nc1*r*2 is satisfied.

On the other hand, the number of terms in text data coincident with synonymous terms associated with Expression 1 among synonymous terms and related terms associated with a phonetic expression of Candidate 2 is represented by Nc2*s*1. The number of terms in text data coincident with synonymous terms associated with Expression 2 among synonymous terms and related terms associated with a phonetic expression of Candidate 2 is represented by Nc2*s*2. The number of terms in text data coincident with related terms associated with Expression 1 among synonymous terms and related terms associated with a phonetic expression of Candidate 2 is represented by Nc2*r*1. The number of terms in text data coincident with related terms associated with Expression 2 among synonymous terms and related terms associated with a phonetic expression of Candidate 2 is represented by Nc2*r*2.

When the total number of terms in text data coincident with related terms associated with a phonetic expression of Candidate 2 is represented by N2, an equation N2=Nc2*s*1+Nc2*s*2+Nc2*r*1+Nc2*r*2 is satisfied.

The control unit 10 counts for an extracted special character, the total number (N1) of terms in accepted text data coincident with synonymous terms and related terms associated with a phonetic expression of Candidate 1 registered in the special character dictionary 111 and the total number (N2) of terms in accepted text data coincident with synonymous terms and related terms associated with a phonetic expression of Candidate 2, for each candidate (at operation S405).

The control unit 10 determines whether both of the total number (N1) of terms coincident with synonymous terms and related terms associated with a phonetic expression of Candidate 1 and the total number (N2) of terms coincident with synonymous terms and related terms associated with a phonetic expression of Candidate 2, which are counted at the operation S405, are zero or not (N1=N2=0?) (at operation S406). When determining that both of the total numbers of coincident terms for Candidate 1 and Candidate 2 are zero (at the operation S406: YES), the control unit 10 deletes the extracted special character (at operation S407). Then, the control unit 10 converts the rest of the text data to a phonogram with the function of a converting unit 104 (at the operation S403), synthesizes a voice with the function of a speech synthesizing unit 105 from the phonogram obtained through conversion (at the operation S404) and terminates the process.

When determining at the operation S406 that both of the total numbers (N1 and N2) of terms coincident with synonymous terms and related terms associated with a phonetic expression of Candidate 1 or a phonetic expression of Candidate 2 are zero (at the operation S406: NO), the control unit 10 determines whether the total number (N1) of terms coincident with synonymous terms and related terms associated with a phonetic expression of Candidate 1 is equal to or larger than the total number (N2) of terms coincident with synonymous terms and related terms associated with a phonetic expression of Candidate 2 or not (N1>N2?) (at operation S408).

The reason for the control unit 10 to compare the total numbers of terms coincident with synonymous terms and related terms for Candidate 1 and Candidate 2 at the operation S408 is as follows. Candidate 1 and Candidate 2 are classified by a difference in the meaning to be recalled from the design of a special character, and synonymous terms and related terms are classified into Candidate 1 and Candidate 2 also by a difference in the meaning. Accordingly, it is possible to determine that an extracted special character is used in a meaning closer to the meaning of one of Candidate 1 and Candidate 2, for which more synonymous terms and more related terms are extracted from the proximity of the special character.

When determining at the operation S408 that the total number (N1) of terms coincident with synonymous terms and related terms associated with a phonetic expression of Candidate 1 is equal to or larger than the total number (N2) of terms coincident with synonymous terms and related terms associated with a phonetic expression of Candidate 2 (at the operation S408: YES), the control unit 10 performs the following process to select a phonetic expression for a special character illustrated in the explanatory view of FIG. 10 from Expression 1/Expression 2/Expression 3 of Candidate 1, since the meaning to be recalled from the extracted special character is a meaning to be classified into Candidate 1.

The control unit 10 determines whether both of the number (Nc1*s*1) of terms coincident with synonymous terms associated with a phonetic expression of Expression 1 of Candidate 1 and the number (Nc1*s*2) of terms coincident with synonymous terms associated with a phonetic expression of Expression 2 are larger than zero or not (Nc1*s*1>0 & Nc1*s*2>0?) (at operation S409).

When determining that both of the numbers (Nc1*s*1 and Nc1*s*2) of terms coincident with synonymous terms associated with phonetic expressions respectively of Expression 1 and Expression 2 of Candidate 1 are larger than zero (at the operation S409: YES), the control unit 10 selects Expression 1 nor Expression 2 but Expression 3 of Candidate 1 as a phonetic expression (at operation S410). This is because selection of a phonetic expression of either one of Expression 1 and Expression 2 causes redundant read-aloud when both of a synonymous term associated with Expression 1 and a synonymous term associated with Expression 2 exist in received text data. Accordingly the control unit 10 replaces the special character with a character string equivalent to BGM of Expression 3 of Candidate 1 in accordance with a phonetic expression of Expression 3, which is BGM, and converts the text data to a phonogram with the function of the converting unit 104 (at operation S411). The control unit 10 synthesizes a voice with the function of the speech synthesizing unit 105 from the phonogram obtained through conversion (at the operation S404) and terminates the process.

When determining that any one of the numbers (Nc1*s*1 or Nc1*s*2) of terms coincident with synonymous terms associated with phonetic expressions respectively of Expression 1 and Expression 2 of Candidate 1 is zero (at the operation S409: NO), the control unit 10 determines whether the number (Nc1*s*1) of terms coincident with synonymous terms associated with a phonetic expression of Expression 1 of Candidate 1 is not zero and the number (Nc1*s*2) of terms coincident with synonymous terms associated with a phonetic expression of Expression 2 of Candidate 1 is zero or not (Nc1*s*1>0 & Nc1*s*2>0?) (at operation S412).

When determining that the number (Nc1*s*1) of terms coincident with synonymous terms associated with a phonetic expression of Expression 1 of Candidate 1 is not zero and the number (Nc1*s*2) of terms coincident with synonymous terms associated with a phonetic expression of Expression 2 of Candidate 1 is zero (at the operation S412: YES), the control unit 10 selects Expression 2 of Candidate 1 as a phonetic expression (at operation S413).

This is because it can be detected from the determination process at the operation S412 that a synonymous term associated with Expression 1 exists in accepted text data and a synonymous term associated with Expression 2 does not exist. In such a case, selection of a phonetic expression of Expression 2 does not cause redundant read-aloud. Accordingly, the control unit 10 replaces the special character with a character string representing a phonetic expression of Expression 2 of Candidate 1 in accordance with a phonetic expression of Expression 2, which is an imitative word or sound effect, and converts the text data to a phonogram with the function of the converting unit 104 (at the operation S411).

When the number (Nc1*s*1) of terms coincident with synonymous terms associated with a phonetic expression of Expression 1 of Candidate 1 is zero or the number (Nc1*s*2) of terms coincident with synonymous terms associated with a phonetic expression of Expression 2 of Candidate 1 is not zero (at the operation S412: NO), the control unit 10 determines whether, conversely the number (Nc1*s*1) of terms coincident with synonymous terms associated with a phonetic expression of Expression 1 of Candidate 1 is zero and the number (Nc1*s*2) of terms coincident with synonymous terms associated with a phonetic expression of Expression 2 of Candidate 1 is not zero or not (Nc1*s*1>0 & Nc1*s*2>0?) (at operation S414).

When determining that the number (Nc1*s*1) of terms coincident with synonymous terms associated with a phonetic expression of Expression 1 of Candidate 1 is zero and the number (Nc1*s*2) of terms coincident with synonymous terms associated with a phonetic expression of Expression 2 of Candidate 1 is not zero (at the operation S414: YES), the control unit 10 selects Expression 1 of Candidate 1 as a phonetic expression (at operation S415).

A case where a synonymous term associated with Expression 1 exists in accepted text data and a synonymous term associated with Expression 2 does not exist has already been deleted at the operation S412. Accordingly it can be detected from the determination process at the operation S414 that a synonymous term associated with Expression 2 exists in accepted text data and a synonymous term associated with Expression 1 does not exist. In such a case, selection of a phonetic expression of Expression 1 does not cause redundant read-aloud. Consequently, the control unit 10 replaces the special character with a character string representing a phonetic expression of Expression 1 of Candidate 1 in accordance with a phonetic expression of Expression 1, which is a reading, and converts the text data to a phonogram with the function of the converting unit 104 (at the operation S411). The control unit 10 synthesizes a voice with the function of the speech synthesizing unit 105 from the phonogram obtained through conversion (at the operation S404) and terminates the process.

On the other hand, when determining that the number (Nc1*s*1) of terms coincident with synonymous terms associated with a phonetic expression of Expression 1 of Candidate 1 is not zero or the number (Nc1*s*2) of terms coincident with synonymous terms associated with a phonetic expression of Expression 2 of Candidate 1 is zero (at the operation S414: NO), the control unit 10 determines whether the number (Nc1*r*1) of terms coincident with related terms associated with a phonetic expression of Expression 1 of Candidate 1 is equal to or larger than the number of terms coincident with related terms (Nc1*r*2) associated with a phonetic expression of Expression 2 or not (Nc1*r*1>Nc1*r*2?) (at operation S416).

A case where synonymous terms associated with phonetic expressions of Expression 1 and Expression 2 of Candidate 1 exist in received text data has already been deleted by the determination process in the steps S409, S412 and S414. Accordingly, when proceeding to the operation S416, neither one of synonymous terms associated with phonetic expressions of Expression 1 and Expression 2 of Candidate 1 exists in the accepted text data (Nc1*s*1=Nc1*s*2=0). Accordingly selection of any one phonetic expression does not cause redundant read-aloud. On the other hand, since the determination process at the operation S406 is provided, the control unit 10 can determine that either one of related terms for Expression 1 and Expression 2 exists though a synonymous term does not exist. Consequently, the control unit 10 selects Expression 1 or Expression 2, which is used in a usage pattern having a stronger connection, in the determination process at the operation S416.

When determining at the operation S416 that the number (Nc1*r*1) of terms coincident with related terms associated with a phonetic expression of Expression 1 of Candidate 1 is equal to or larger than the number (Nc1*r*2) of terms coincident with related terms associated with a phonetic expression of Expression 2 of Candidate 1 (at the operation S416: YES), the control unit 10 selects Expression 1 of Candidate 1 as a phonetic expression (at the operation S415). The control unit 10 replaces the special character with a character string of Expression 1 of Candidate 1 in accordance with a phonetic expression of Expression 1, which is a reading, and converts the text data to a phonogram with the function of the converting unit 104 (at the operation S411). The control unit 10 synthesizes a voice with the function of the speech synthesizing unit 105 from the phonogram obtained through conversion (at the operation S404) and terminates the process.

When determining at the operation S416 that the number (Nc1*r*1) of terms coincident with related terms associated with a phonetic expression of Expression 1 of Candidate 1 is smaller than the number (Nc1*r*2) of terms coincident with related terms associated with a phonetic expression of Expression 2 of Candidate 1 (at the operation S416: NO), the control unit 10 selects Expression 2 of Candidate 1 as a phonetic expression. The control unit 10 replaces the special character with a character string of Expression 2 of Candidate 1 in accordance with a phonetic expression of Expression 2, which is an imitative word or a sound effect, and converts the text data to a phonogram with the function of the converting unit 104 (at the operation S411). The control unit 10 synthesizes a voice with the function of the speech synthesizing unit 105 from the phonogram obtained through conversion (at the operation S404) and terminates the process.

On the other hand, when determining at the operation S408 that the total number of terms coincident with synonymous terms and related terms associated with a phonetic expression of Candidate 1 is smaller than the total number of terms coincident with synonymous terms and related terms associated with a phonetic expression of Candidate 2 (at the operation S408: NO), the following process is performed to select a phonetic expression for the special character illustrated in the explanatory view of FIG. 10 from Expression 1/Expression 2/Expression 3 of Candidate 2, since a meaning to be recalled from the extracted character is a meaning to be classified into Candidate 2.

The control unit 10 determines whether both of the number (Nc2*s*1) of terms coincident with synonymous terms associated with a phonetic expression of Expression 1 of Candidate 2 and the number (Nc2*s*2) of terms coincident with synonymous terms associated with a phonetic expression of Expression 2 are larger than zero or not (Nc2*s*1>0 & Nc2*s*2>0?) (at operation S417), as in the process for selecting a phonetic expression of Candidate 1.

When determining that both of the numbers (Nc2*s*1 and Nc2*s*2) of terms coincident with synonymous terms associated with phonetic expressions respectively of Expression 1 and Expression 2 of Candidate 2 are larger than zero (at the operation S417: YES), the control unit 10 does not select any one of Expression 1 and Expression 2 as a phonetic expression but selects Expression 3 of Candidate 2 (at operation S418). The control unit 10 replaces the special character with a character string equivalent to BGM of Expression 3 of Candidate 2 in accordance with a phonetic expression of Expression 3, which is BGM, and converts the text data to a phonogram with the function of the converting unit 104 (at the operation S411). The control unit 10 synthesizes a voice with the function of the speech synthesizing unit 105 from the phonogram obtained through conversion (at the operation S404) and terminates the process.

When determining that any one of the numbers (Nc2*s*1 or Nc2*s*2) of terms coincident with synonymous terms associated with phonetic expressions respectively of Expression 1 and Expression 2 of Candidate 2 is zero (at the operation S417: NO), the control unit 10 determines whether the number (Nc2*s*1) of terms coincident with synonymous terms associated with a phonetic expression of Expression 1 of Candidate 2 is not zero and the number (Nc2*s*2) of terms coincident with synonymous terms associated with a phonetic expression of Expression 2 of Candidate 2 is zero or not (Nc2*s*1>0 & Nc2*s*2>0?) (at operation S419).

When determining that the number (Nc2*s*1) of terms coincident with synonymous terms associated with a phonetic expression of Expression 1 of Candidate 2 is not zero and the number (Nc2*s*2) of terms coincident with synonymous terms associated with a phonetic expression of Expression 2 of Candidate 2 is zero (at the operation S419: YES), the control unit 10 selects Expression 2 of Candidate 2 as a phonetic expression (at operation S420). The control unit 10 replaces the special character with a character string representing a phonetic expression of Expression 2 of Candidate 2 in accordance with a phonetic expression of Expression 2, which is an imitative word or a sound effect, and converts the text data to a phonogram with the function of the converting unit 104 (at the operation S411). The control unit 10 synthesizes a voice with the function of the speech synthesizing unit 105 from the phonogram obtained through conversion (at the operation S404) and terminates the process.

When the number (Nc2*s*1) of terms coincident with synonymous terms associated with a phonetic expression of Expression 1 of Candidate 2 is zero or the number (Nc2*s*2) of terms coincident with synonymous terms associated with a phonetic expression of Expression 2 of Candidate 2 is not zero (at the operation S419: NO), the control unit 10 determines whether, conversely, the number (Nc2*s*1) of terms coincident with synonymous term associated with a phonetic expression of Expression 1 of Candidate 2 is zero and the number (Nc2*s*2) of terms coincident with synonymous terms associated with a phonetic expression of Expression 2 and Candidate 2 is not zero or not (Nc2*s*1>0 & Nc2*s*2>0?) (at operation S421).

When determining that the number (Nc2*s*1) of terms coincident with synonymous terms associated with a phonetic expression of Expression 1 of Candidate 2 is zero and the number (Nc2*s*2) of terms coincident with synonymous terms associated with a phonetic expression of Expression 2 of Candidate 2 is not zero (at the operation S421: YES), the control unit 10 selects Expression 1 of Candidate 2 as a phonetic expression (at operation S422). The control unit 10 replaces the special character with a character string representing a phonetic expression of Expression 1 of Candidate 2 in accordance with a phonetic expression of Expression 1, which is a reading, and converts the text data to a phonogram with the function of the converting unit 104 (at the operation S411). The control unit 10 synthesizes a voice from the phonogram with the function of the speech synthesizing unit 105 (at the operation S404) and terminates the process.

When determining that the number (Nc2*s*1) of terms coincident with synonymous terms associated with a phonetic expression of Expression 1 of Candidate 2 is not zero or the number (Nc2*s*2) of terms coincident with synonymous terms associated with a phonetic expression of Expression 2 of Candidate 2 is zero (at the operation S421: NO), the control unit 10 determines whether the number (Nc2*r*1) of terms coincident with related terms associated with a phonetic expression of Expression 1 of Candidate 2 is equal to or larger than the number of terms coincident with related terms (Nc2*r*2) associated with a phonetic expression of Expression 2 or not (Nc2*r*1≧Nc2*r*2?) (at operation S423).

When determining that the number (Nc2*r*1) of terms coincident with related terms associated with a phonetic expression of Expression 1 of Candidate 2 is equal to or larger than or the number (Nc2*r*2) of terms coincident with related terms associated with a phonetic expression of Expression 2 of Candidate 2 (at the operation S423: YES), the control unit 10 selects Expression 1 of Candidate 2 as a phonetic expression (at the operation S422). The control unit 10 replaces the special character with a character string of Expression 1 of Candidate 2 in accordance with a phonetic expression of Expression 1, which is a reading, and converts the text data to a phonogram with the function of the converting unit 104 (at the operation S411). The control unit 10 synthesizes a voice with the function of the speech synthesizing unit 105 from the phonogram obtained through conversion (at the operation S404) and terminates the process.

When determining at the operation S423 that the number (Nc2*r*1) of terms coincident with related terms associated with a phonetic expression of Expression 1 of Candidate 2 is smaller than the number (Nc2*r*2) of terms coincident with related terms associated with a phonetic expression of Expression 2 of Candidate 2 (at the operation S423: NO), the control unit 10 selects Expression 2 of Candidate 2 as a phonetic expression (at the operation S420). The control unit 10 replaces the special character with a character string of Expression 2 of Candidate 2 in accordance with a phonetic expression of Expression 2, which is an imitative word or a sound effect, and converts the text data to a phonogram with the function of the converting unit 104 (at the operation S411). The control unit 10 synthesizes a voice with the function of the speech synthesizing unit 105 from the phonogram obtained through conversion (at the operation S404) and terminates the process.

Figure 12:
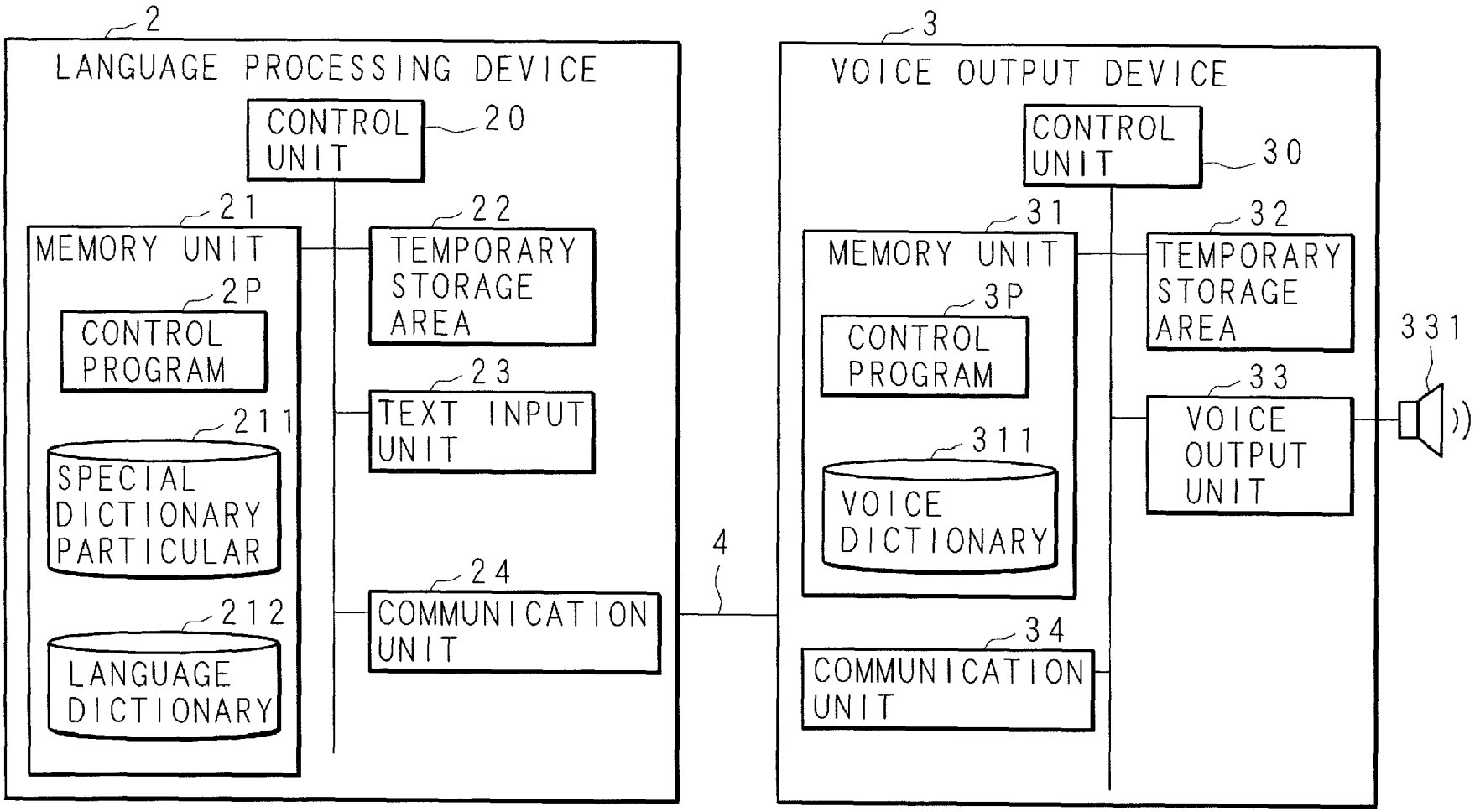
FIG. 12 is a block diagram for illustrating an example of the structure of a speech synthesizing system according to Embodiment 5.
Figure 13:
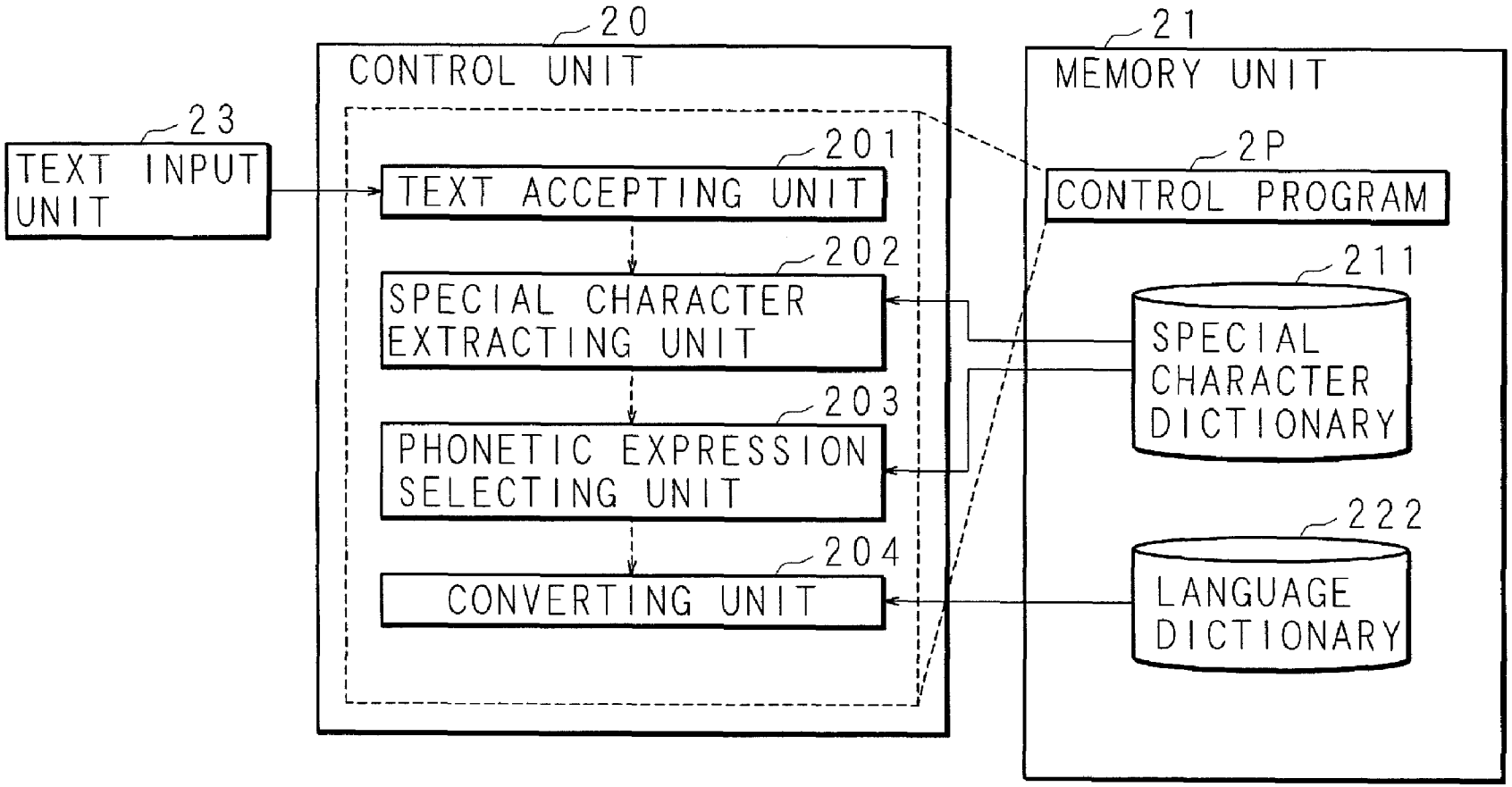
FIG. 13 is a functional block diagram for illustrating an example of each function of a control unit of a language processing device which constitutes a speech synthesizing system according to Embodiment 5.
Figure 14:
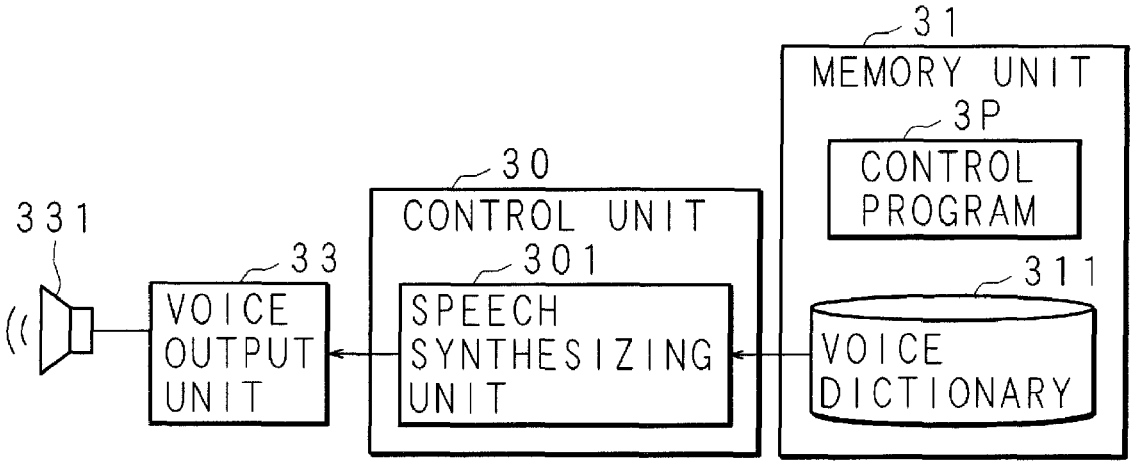
FIG. 14 is a functional block diagram for illustrating an example of each function of a control unit of a voice output device which constitutes a speech synthesizing system according to Embodiment 5.

The process illustrated in the operation chart of FIGS. 12, 13 and 14 may be executed for each sentence when text data is not composed of one sentence but of a plurality of sentences, for example. Accordingly the number of terms coincident with synonymous terms and related terms is counted at the operation S405 an assumption that the area wherein the total number of terms in text data coincident with synonymous terms and related terms is counted is the proximity of a special character in text data equivalent to one sentence including the special character. However, the number of coincident synonymous terms and related terms may be counted on assumption that the proximity of a special character is not only text data equivalent to one sentence but text data equivalent to a plurality of sentences before and after the sentence including the special character.

Furthermore, when accepted text data is provided with accessory text such as the subject, the number of related terms may be counted in the accessory text.

By the process procedure illustrated in the operation chart of FIGS. 12, 13 and 14, a phonetic expression, in the proximity of which a synonymous term associated with an extracted special character does not exist, is selected and a phonetic expression for which more coincident related terms exist is selected when a synonymous term does not exist. In such a manner, it is possible to inhibit read-aloud in a meaning different from the intention of the user and redundant read-aloud and to realize proper read-out true to the intention of the user.

Embodiment 5

Embodiments 1 to 4 have a structure wherein the control unit 10 of the speech synthesizing device 1 functions as both of the converting unit 104 and the speech synthesizing unit 105. However, the present embodiment is not limited to this and may have a structure wherein a converting unit 104 and a speech synthesizing unit 105 are provided separately in different devices. In Embodiment 5, the effect of the present embodiment for properly reading aloud a special character is realized with a language processing device, which is provided with the function of a phonetic expression selecting unit 103 and the converting unit 104, and a voice output device which is provided with the function of synthesizing a voice from a phonogram.

FIG. 12 is a block diagram for illustrating an example of the structure of a speech synthesizing system according to Embodiment 5. The speech synthesizing system is structured by including: a language processing device 2 for performing a process for accepting text data and converting the text data to a phonogram to be used by a voice output device 3 for synthesizing a voice, which will be described below; and the voice output device 3 for accepting the phonogram obtained through conversion by the language processing device 2, synthesizing a voice from the accepted phonogram and outputting the voice.

The language processing device 2 and the voice output device 3 are connected with each other by a communication line 4 and can transmit and receive data to and from each other.

The language processing device 2 comprises: a control unit 20 for controlling the operation of each component which will be explained below; a memory unit 21 which is a hard disk, or the like; a temporary storage area 22 provided with a memory such as a RAM (Random Access Memory); a text input unit 23 provided with a keyboard, or the like; and a communication unit 24 to be connected with the voice output device 3 via the communication line 4.

The memory unit 21 stores a control program 2P, which is a program to be used for executing a process for converting text data to a phonogram to be used for synthesizing a voice, or the like. The control unit 20 reads out the control program 2P from the memory unit 21 and executes the control program 2P, so as to execute a selection process of a phonetic expression and a conversion process of text data to a phonogram.

The memory unit 21 further stores: a special character dictionary 211 in which a pictographic character, a face mark, a symbol and the like and a phonetic expression including the reading thereof are registered; and a language dictionary 212, in which correspondence of a segment, a word and the like constituting text composed of kanji characters, kana characters and the like with phonogram is registered.

The temporary storage area 22 is used by the control unit 20 not only for reading out a control program but also for reading out a variety of information from the special character dictionary 211 and the language dictionary 212. Moreover, the temporary storage area 22 is used for temporarily storing a variety of information which is generated in execution of each process.

The text input unit 23 is part, such as a keyboard and a letter key, for accepting input of text. The control unit 20 accepts text data inputted through the text input unit 23.

The communication unit 24 realizes data communication with the voice output device 3 via the communication line 4. The control unit 20 transmits a phonogram, which is obtained through conversion of text data including a special character, with the communication unit 24.

The voice output device 3 comprises: a control unit 30 for controlling the operation of each component, which will be explained below; a memory unit 31 which is a hard disk, or the like; a temporary storage area 32 provided with a memory such as a RAM (Random Access Memory); a voice output unit 33 provided with a speaker 331; and a communication unit 34 to be connected with the language processing deice 2 via the communication line 4.

The memory unit 31 stores a control program to be used for executing the process of speech synthesis. The control unit 30 reads out the control program from the memory unit 31 and executes the control program, so as to execute each operation of speech synthesis.

The memory unit 31 further stores a voice dictionary (waveform dictionary) 311, in which a waveform group of each voice is registered.

The temporary storage area 32 is used by the control unit 30 not only for reading out the control program but also for reading out a variety of information from the voice dictionary 311. Moreover, the temporary storage area 32 is used for temporarily storing a variety of information which is generated in execution of each process by the control unit 30.

The voice output unit 33 is provided with the speaker 331. The control unit 30 gives a voice, which is synthesized referring to the voice dictionary 311, to voice output part and causes the voice output part to output a voice through the speaker 331.

The communication unit 34 realizes data communication with the language processing device 2 via the communication line 4. The control unit 30 receives phonogram, which is obtained through conversion of text data including a special character, with the communication unit 34.

FIG. 13 is a functional bock diagram for illustrating an example of each function of the control unit 20 of the language processing device 2 which constitutes a speech synthesizing system according to Embodiment 5. The control unit 20 of the language processing device 2 reads out a control program from the memory unit 21 so as to function as: a text accepting unit 201 for accepting text data inputted through the text input unit 23; a special character extracting unit 202 for extracting a special character from the text data accepted by the accepting unit 201; a phonetic expression selecting unit 203 for selecting a phonetic expression for the extracted special character; and a converting unit 204 for converting the accepted text data to a phonogram in accordance with the phonetic expression selected for the special character.

It is to be noted that the details of each function are the same as those of each function of the control unit 10 of the speech synthesizing device 1 according to Embodiment 1 and, therefore, detailed explanation thereof is omitted.

The control unit 20 of the language processing device 2 accepts text data by functioning as the text accepting unit 201, and refers to the special character dictionary 211 of the memory unit 21 and extracts a special character by functioning as the special character extracting unit 202. The control unit 20 of the language processing device 2 refers to the special character dictionary 211 and selects a phonetic expression for the extracted special character by functioning as the phonetic expression selecting unit 203. The control unit 20 of the language processing device 2 converts the text data to a phonogram in accordance with the selected phonetic expression by functioning as the converting unit 204.

It is to be noted that the control unit 20 according to Embodiment 5 is constructed to insert a control character string to a character string, which is obtained by replacement with a phonetic expression selected for a special character, in accepted text data and convert the text data to a phonogram by a language analysis, as in the speech synthesizing device 1 according to Embodiment 2.

FIG. 14 is a functional block diagram for illustrating an example of each function of the control unit 30 of the voice output device 3 which constitutes a speech synthesizing system according to Embodiment 5. The control unit 30 of the voice output device 3 reads out a control program from the memory unit 31, so as to function as a speech synthesizing unit 301 for creating a synthesized voice from a transmitted phonogram and outputting the synthesized voice to the voice output unit 33.

The details of the speech synthesizing unit 301 are also the same as those of the function of the control unit 10 of the speech synthesizing device 1 according to Embodiment 1 functioning as the speech synthesizing unit 105 and, therefore, detailed explanation thereof is omitted.

The control unit 30 of the voice output device 3 receives the phonogram transmitted by the language processing device 2 by the communication unit 34, and refers to the voice dictionary 311, synthesizes a voice for the received a phonogram and outputs the voice to the voice output unit 33 by functioning as the speech synthesizing unit 301.

The following description will explain the process of the language processing device 2 and the voice output device 3, which constitute a speech synthesizing system according Embodiment 5. It is to be noted that the content of the special character dictionary 211 to be stored in the memory unit 21 of the language processing device 2 may have the same structure as that of any special character dictionary 111 to be stored in a memory unit 11 of a speech synthesizing device 1 of Embodiments 1 to 4. However, Embodiment 5 will be explained using an example wherein the content registered in the special character dictionary 211 is the same as that of Embodiment 1.

Figure 15:
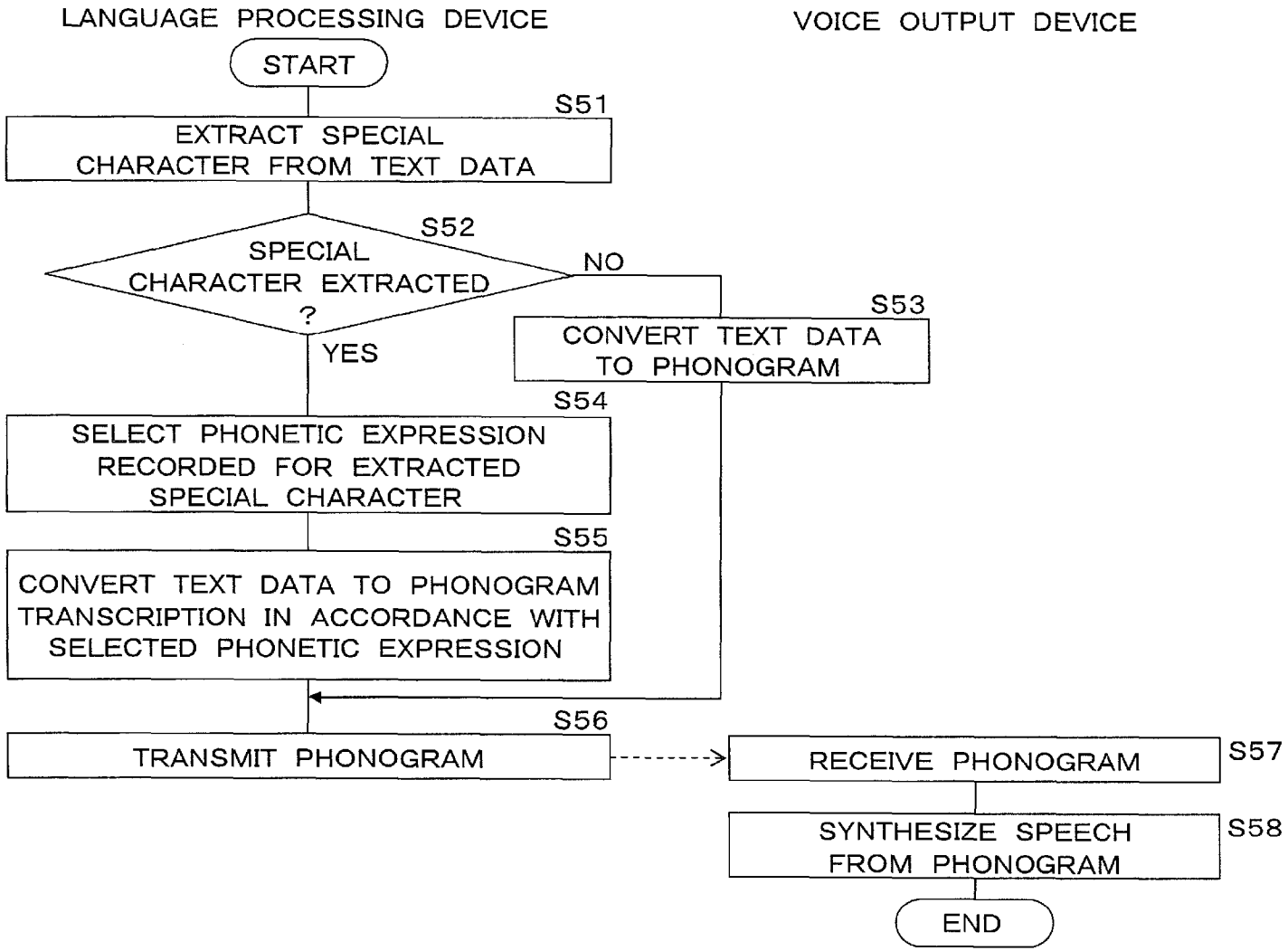
FIG. 15 is an operation chart for illustrating an example of the process procedure of a control unit of a language processing device and a control unit of a voice output device according to Embodiment 5 from accepting of text to synthesis of a voice.

FIG. 15 is an operation chart for illustrating an example of the process procedure of the control unit 20 of the language processing device 2 and the control unit 30 of the voice output device 3 according to Embodiment 5 from accepting of text to synthesis of a voice.

When receiving input of text from the text input unit 23 by the function of the text reception unit 201, the control unit 20 of the language processing device 2 performs a process for matching the received text data against an identification code registered in the special character dictionary 211 and extracting a special character (at operation S51).

The control unit 20 of the language processing device 2 determines whether a special character has been extracted at the operation S51 or not (at operation S52).

When determining at the operation S52 that a special character has not been extracted (at the operation S52: NO), the control unit 20 of the language processing device 2 converts the received text data to a phonogram with the function of the converting unit 204 (at operation S53).

When determining at the operation S52 that a special character has been extracted (at the operation S52: YES), the control unit 20 of the language processing device 2 selects a phonetic expression registered for the special character extracted from the special character dictionary 211 (at operation S54). The control unit 20 of the language processing device 2 converts the text data including a character string equivalent to the selected phonetic expression to a phonogram with the function of the converting unit 204 (at operation S55).

The control unit 20 of the language processing device 2 transmits the phonogram obtained through conversion in the steps S53 and S55 to the voice output device 3 with the communication unit 24 (at operation S56).

The control unit 30 of the voice output device 3 receives the phonogram by the control unit 34 (at operation S57), synthesizes a voice from the received a phonogram by the function of the speech synthesizing unit 301 (at operation S58) and terminates the process.

The process described above makes it possible to select a proper phonetic expression and convert text data including a special character to a phonogram with the language processing device 2, which is provided with the function of the phonetic expression selecting unit 203 and the converting unit 204, and to synthesize a voice suitable for the special character from the phonogram obtained through conversion and output the voice with the voice output device 3, which is provided with the function of the speech synthesizing unit 301.

The speech synthesizing system according to Embodiment 5 described above provides the following effect. Both of the process, which is to be executed by the control unit 10 of the speech synthesizing device 1 according to Embodiments 1 to 4 when functioning as the phonetic expression selecting unit 103, and the process which is to be executed by the control unit 10 when functioning as the converting unit 104, increase load. Accordingly, when the speech synthesizing device 1 is applied to a mobile telephone provided with a function of reading aloud a received mail, for example, the number of computing steps necessary for functioning as the phonetic expression selecting unit 103 and the converting unit 104 increases and it becomes difficult to realize the function. However, when the phonetic expression selecting unit 103 and the converting unit 104 are provided in a device providing sufficient performance and a phonogram obtained through conversion including a special character is transmitted to the voice output device 3 provided with a function of synthesizing and outputting a voice, the voice output device 3 may be constructed to have only a function of synthesizing a voice from a phonogram. In such a manner, it becomes possible to realize proper read-aloud of text data including a special character with even a device, such as a mobile telephone, for which downsizing and weight saving are preferred.

It is to be noted that the function of the phonetic expression selecting unit 203 and the converting unit 204 and the function of the speech synthesizing unit 301 are separated respectively to the language processing device 2 and the voice output device 3 in Embodiment 5, so as to perform conversion to a phonogram and transmit the phonogram with the language processing device 2. However, the control unit 20 of the language processing device 2 does not necessarily have to function as the converting unit 204. In such a case, the control unit 20 of the language processing device 2 may be constructed to output: a phonetic expression selected without performing conversion to a phonogram; and text data including information indicative of a position equivalent to the position of a special character. In such a case, the voice output device 3 properly synthesizes a reading, an imitative word, a sound effect or BGM from text data in accordance with a phonetic expression transmitted from the language processing device 2 and outputs a voice. In such a case, a character string equivalent to a phonetic expression may be transmitted as the selected phonetic expression.

It is to be noted that, when receiving text data including a special character together with a phonetic expression of the special character inputted arbitrarily by the user, the control unit 20 of the language processing device 2 according to Embodiment 5 may select not a phonetic expression from the special character dictionary 111 but the phonetic expression accepted together and transmit a phonogram obtained through conversion in accordance with the phonetic expression to the voice output device 3. In concrete terms, the language processing device according to Embodiment 5 is constructed to perform the process other than at the operation S204 in the process procedure illustrated in the operation chart of FIG. 6 in Embodiment 1 and transmit a phonogram obtained through conversion to the voice output device 3.

The speech synthesizing device 1 or the voice output device 3 according to Embodiments 1 to 5 has a structure that a synthesized voice is outputted from a speaker 331 provided in the voice output unit 33. However, the present embodiment is not limited to this, and the speech synthesizing device 1 or the voice output device 3 may be constructed to output a synthesized voice as a file.

Moreover, the speech synthesizing device 1 and the language processing device 2 according to Embodiments 1 to 5 are constructed to have a keyboard or the like as a text input unit 13, 23 for accepting input of text. However, the present embodiment is not limited to this, and text data to be accepted by the control unit 10 or the control unit 20 functioning as a text accepting unit 201 may be text data in the form of file to be transmitted and received, such as a mail, or text data, which is read out by the control unit 10 or the control unit 20 from a portable record medium such as a flexible disk, a CD-ROM, a DVD or a flash memory.

It is to be noted that the special character dictionary 111, 211 to be stored in the memory unit 11 or the memory unit 21 in Embodiments 1 to 5 is constructed to be stored separately from the language dictionary 112, 212. However, the special character dictionary 111, 211 may be constructed as a part of the language dictionary 112, 212.

All examples and conditional language recited herein are intended for pedagogical purposes to aid the reader in understanding the embodiment and the concepts contributed by the inventor to furthering the art, and are to be construed as being without limitation to such specifically recited examples and conditions, nor does the organization of such examples in the specification relate to a showing of the superiority and inferiority of the embodiment. Although the embodiments have been described in detail, it should be understood that the various changes, substitutions, and alterations could be made hereto without departing from the spirit and scope of the embodiment.

What is claimed is:

1. A speech synthesizing device, the device comprising:

a text accepting unit to accept text data;

an extracting unit to extract a special character including a pictographic character, a face mark or a symbol from text data accepted by the text accepting unit;

a dictionary database to register as phonetic expressions information on both a phonetic expression to read aloud a meaning of each special character and another phonetic expression;

a selecting unit to select a phonetic expression of an extracted special character from the dictionary database when the extracting unit extracts the special character;

a judging unit to judge whether a special character extracted by the extracting unit is used for the purpose of substitution for a character or for another purpose;

a converting unit to convert the text data accepted by the accepting unit to a phonogram in accordance with a phonetic expression selected by the selecting unit in association with the extracted special character; and a speech synthesizing unit to synthesize a voice from a phonogram obtained by the converting unit, wherein the selecting unit selects a phonetic expression to read aloud a corresponding meaning from the dictionary database when the judging unit judges that a special character extracted by the extracting unit is used for the purpose of substitution for a character and then the selecting unit selects another corresponding phonetic expression from the dictionary database when the judging unit judges that a special character extracted by the extracting unit is used for another purpose.

2. A speech synthesizing device according to claim 1, wherein the phonetic expressions are classified by a usage pattern or a meaning of each special character.

3. The speech synthesizing device according to claim 1, wherein one or a plurality of related terms related respectively to phonetic expressions of each special character are further registered in the dictionary database in an associated manner, the speech synthesizing device further comprises an unit for determining whether or not the related terms have been detected from the proximity of a special character extracted by the extracting unit in accepted text data, and the selecting unit selects a phonetic expression associated with a detected related term from the dictionary database when it is determined that the related term has been detected.

4. The speech synthesizing device according to claim 3, wherein the related term further includes a reading transcription of a meaning corresponding to a phonetic expression other than a phonetic expression associated with each of the related term.

5. The speech synthesizing device according to claim 3 further comprising:

an unit for accepting another text data as reference text data corresponding to text data, wherein the selecting unit determine whether or not the related terms are detected also from accepted reference text data.

6. The speech synthesizing device according to claim 1, wherein one or a plurality of synonymous terms with a meaning of a special character represented by each phonetic expression are further registered in the dictionary database in association respectively with phonetic expressions of each special character, the speech synthesizing device further comprises an unit for determining whether or not the synonymous terms have been detected from the proximity of a special character extracted by the extracting unit in accepted text data is provided, and the selecting unit selects a phonetic expression other than a phonetic expression associated with a detected synonymous term from a plurality of phonetic expressions of an extracted special character when it is determined that the synonymous term has been detected.

7. The speech synthesizing device according to claim 6 further comprising:

an unit for accepting another text data as reference text data corresponding to text data wherein the selecting unit determines whether or not the synonymous terms are also detected from accepted reference text data.

8. The speech synthesizing device according to claim 1, further comprising:

a co-occurrence dictionary database, in which a term group that occurs together in a same context with respective phonetic expressions of a special character is registered in an associated manner; and an unit for determining whether or not any term of a term group registered in the co-occurrence dictionary database has been detected from the proximity of a special character extracted by the extracting unit in accepted text data, wherein the selecting unit selects a phonetic expression associated with a detected term group when it is determined that any term of the term group has been detected.

9. The speech synthesizing device according to claim 1, wherein a phonetic expression of the special character is any one of a reading, an imitative word, a sound effect, music and silence.

10. The speech synthesizing device according to claim 9, further comprising:

an outputting unit for outputting a dictionary database, which is updated by registration of a accepted special character, together with text data including the accepted special character.

11. The speech synthesizing device according to claim 1, further comprising:

an unit for accepting a special character, a phonetic expression of the special character and classification of the phonetic expression, wherein the dictionary database is updated by registration of both an accepted special character and an accepted phonetic expression of the special character separately on the basis of the classification accepted together.

12. The speech synthesizing device according to claim 1, further comprising:

an unit for accepting a special character included in text data and a phonetic expression of the special character when accepting the text data, wherein the converting unit converts text data including an accepted special character to a phonogram in accordance with an accepted phonetic expression when the extracting unit extracts the special character from accepted text data.

13. The speech synthesizing device according to claim 1, wherein the converting unit converts a special character in accepted text data to a control character string indicative of a phonetic expression selected by the selecting unit when a phonetic expression selected by the selecting unit in association with a special character extracted by the extracting unit is not a phonetic expression to read aloud a meaning, and the speech synthesizing unit synthesizes any one of a sound effect, an imitative word, music and silence in accordance with the control character string when the control character string is included in a phonogram obtained through conversion by the converting unit.

14. The speech synthesizing device according to claim 1, wherein the speech synthesizing unit synthesizes any one of a sound effect, an imitative word and music from a character string corresponding to the special character in a phonogram obtained through conversion by the converting unit in accordance with the phonogram converted by the converting units and a phonetic expression selected by the selecting unit.

15. A speech synthesizing system, the system comprising:

a language processing device to convert text data to a phonogram; and a speech synthesizing device to receive a phonogram from the language processing device and synthesizing a voice from the phonogram, wherein the language processing device comprises;

a text accepting unit to accept text data;

an extracting unit to extract a special character including a pictographic character, a face mark or a symbol from text data accepted by the text reception unit;

a dictionary database to register as phonetic expressions information on both a phonetic expression to read aloud a meaning of each special character and another phonetic expression;

a selecting unit to select a phonetic expression of an extracted special character from the dictionary database when the extracting unit extracts a special character;

a judging unit to judge whether a special character extracted by the extracting unit is used for the purpose of substitution for a character or for another purpose;

a converting unit to convert text data including a special character accepted by the accepting unit to a phonogram in accordance with a phonetic expression selected by the selecting unit for the extracted special character; and a transmitting unit to transmit a phonetic transcription to the speech synthesizing device, wherein the selecting unit selects a phonetic expression to read aloud a corresponding meaning from the dictionary database when the judging unit judges that a special character extracted by the extracting unit is used for the purpose of substitution for a character and then the selecting unit selects another corresponding phonetic expression from the dictionary database when the judging unit judges that a special character extracted by the extracting unit is used for another purpose.

16. A language processing device, the device comprising:

an accepting unit to accept text data;

an extracting unit to extract a special character including a pictographic character, a face mark or a symbol from text data accepted by the accepting unit;

a dictionary database to register as phonetic expressions information on both a phonetic expression to read aloud a meaning of each special character and another phonetic expression;

a selecting unit to select a phonetic expression of an extracted special character from the dictionary database when the extracting unit extracts the special character;

a judging unit to judge whether a special character extracted by the extracting unit is used for the purpose of substitution for a character or for another purpose; and a converting unit to convert text data including a special character accepted by the accepting unit to a phonogram for synthesizing a voice in accordance with a phonetic expression selected by the selecting unit in association with the extracted special character, wherein the selecting unit selects a phonetic expression to read aloud a corresponding meaning from the dictionary database when the judging unit judges that a special character extracted by the extracting unit is used for the purpose of substitution for a character and then the selecting unit selects another corresponding phonetic expression from the dictionary database when the judging unit judges that a special character extracted by the extracting unit is used for another purpose.

17. A language processing device, the device comprising:

an accepting unit to accept text data;

an extracting unit to extract a special character including a pictographic character, a face mark or a symbol from text data accepted by the accepting unit;

a dictionary database in which a plurality of special characters and a plurality of phonetic expressions for each special character are registered;

a selecting unit to select a phonetic expression of an extracted special character from the dictionary database when the extracting unit extracts the special character; and a converting unit to convert text data including a special character accepted by the accepting unit to a phonogram for synthesizing a voice in accordance with a phonetic expression selected by the selecting unit in association with the extracted special character, wherein the converting unit converts a special character in accepted text data to a control character string indicative of a phonetic expression selected by the selecting unit when a phonetic expression selected by the selecting unit in association with a special character extracted by the extracting unit is not a phonetic expression to read aloud a meaning, and the language processing device further comprises a unit to transmit a phonogram including the control character string to the outside.

18. A language processing device, the device comprising:

an accepting unit to accept text data;

an extracting unit to extract a special character including a pictographic character, a face mark or a symbol from text data accepted by the accepting unit;

a converting unit to convert text data including a special character to a phonogram to be used for synthesizing a voice;

a dictionary database to register as phonetic expressions information on both a phonetic expression to read aloud a meaning of each special character and another phonetic expression;

a selecting unit to select a phonetic expression of an extracted special character from the dictionary database when the extracting unit extracts the special character;

a judging unit to judge whether a special character extracted by the extracting unit is used for the purpose of substitution for a character or for another purpose; and a unit to transmit a phonetic expression selected by the selecting unit, a position of the special character in accepted text data and a phonogram obtained by the converting unit to the outside, wherein the selecting unit selects a phonetic expression to read aloud a corresponding meaning from the dictionary database when the judging unit judges that a special character extracted by the extracting unit is used for the purpose of substitution for a character and then the selecting unit selects another corresponding phonetic expression from the dictionary database when the judging unit judges that a special character extracted by the extracting unit is used for another purpose.

19. A speech synthesizing method, the method comprising:

accepting text data;

extracting a special character including a pictographic character, a face mark or a symbol from the text data;

selecting a phonetic expression of an extracted special character from a dictionary database to register as phonetic expressions information on both a phonetic expression to read aloud a meaning of each special character and another phonetic expression;

converting the text data to a phonogram in accordance with a selected phonetic expression;

judging whether the extracted special character is used for the purpose of substitution for a character or for another purpose; and synthesizing a voice from the phonogram, wherein a phonetic expression to read aloud a corresponding meaning is selected from the dictionary database when it is judged that the extracted special character extracted is used for the purpose of substitution for a character and then another corresponding phonetic expression is selected from the dictionary database when it is judged that the extracted special character is used for another purpose.

20. A computer readable recording medium in which a program for making the computer execute an speech synthesizing is recorded, the program comprising:

receiving text data;

extracting a special character including a pictographic character, a face mark or a symbol from the text data;

selecting a phonetic expression of an extracted special character from a dictionary database to register as phonetic expressions information on both a phonetic expression to read aloud a meaning of each special character and another phonetic expression;

converting the text data to a phonogram in accordance with the phonetic expression selected for the extracted special character;

judging whether the special character extracted is used for the purpose of substation for a character or for another purpose; and synthesizing a voice from the phonogram, wherein a phonetic expression to read aloud a corresponding meaning is selected from the dictionary database when it is judged that the extracted special character extracted is used for the purpose of substitution for a character and then another corresponding phonetic expression is selected from the dictionary database when it is judged that the extracted special character is used for another purpose.

* * * * *